US009208775B2

(12) United States Patent
Subasingha et al.

(10) Patent No.: US 9,208,775 B2
(45) Date of Patent: Dec. 8, 2015

(54) SYSTEMS AND METHODS FOR DETERMINING PITCH PULSE PERIOD SIGNAL BOUNDARIES

(71) Applicant: QUALCOMM Incorporated, San Diego, CA (US)

(72) Inventors: Subasingha Shaminda Subasingha, San Diego, CA (US); Venkatesh Krishnan, San Diego, CA (US); Vivek Rajendran, San Diego, CA (US); Stephane Pierre Villette, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 206 days.

(21) Appl. No.: 14/015,996

(22) Filed: Aug. 30, 2013

(65) Prior Publication Data

US 2014/0236585 A1 Aug. 21, 2014

Related U.S. Application Data

(60) Provisional application No. 61/767,470, filed on Feb. 21, 2013.

(51) Int. Cl.
*G10L 19/10* (2013.01)
*G10L 13/02* (2013.01)
(Continued)

(52) U.S. Cl.
CPC ..... *G10L 13/02* (2013.01); *G10L 19/005* (2013.01); *G10L 19/10* (2013.01); *G10L 25/90* (2013.01)

(58) Field of Classification Search
CPC ..... G10L 19/005; G10L 19/04; G10L 25/90; G10L 13/04; G10L 19/06; G10L 19/07; G10L 19/097; G10L 19/10; G10L 19/12; G10L 19/18; G10L 25/93; H03M 7/3082
USPC ..... 704/220, 500–504, 207, 230, 225, 258, 704/265, 205, 268, 223, 212
See application file for complete search history.

(56) References Cited

U.S. PATENT DOCUMENTS 3,979,557 A * 9/1976 Schulman et al. ..... 704/207
6,490,562 B1 * 12/2002 Kamai et al. ..... 704/258
6,526,376 B1 * 2/2003 Villette et al. ..... 704/207
(Continued)

FOREIGN PATENT DOCUMENTS

CN 101553868 B 8/2012
TW 201246060 A 11/2012

OTHER PUBLICATIONS

Partial International Search Report—PCT/US2013/057864—ISA/EPO—Feb. 4, 2014.
(Continued)

*Primary Examiner* — Vijay B Chawan
(74) *Attorney, Agent, or Firm* — Austin Rapp & Hardman

(57) ABSTRACT

A method for determining pitch pulse period signal boundaries by an electronic device is described. The method includes obtaining a signal. The method also includes determining a first averaged curve based on the signal. The method further includes determining at least one first averaged curve peak position based on the first averaged curve and a threshold. The method additionally includes determining pitch pulse period signal boundaries based on the at least one first averaged curve peak position. The method also includes synthesizing a speech signal.

48 Claims, 27 Drawing Sheets

(51) Int. Cl.
*G10L 25/90* (2013.01)
*G10L 19/005* (2013.01)

(56) References Cited

U.S. PATENT DOCUMENTS

| | | | | |
|---|---|---|---|---|
| 2001/0003812 | A1 | 6/2001 | Ehara et al. | |
| 2005/0071153 | A1 | 3/2005 | Tammi et al. | |
| 2005/0228648 | A1 | 10/2005 | Heikkinen | |
| 2005/0267746 | A1* | 12/2005 | Jelinek et al. | 704/226 |
| 2008/0249767 | A1* | 10/2008 | Ertan | 704/219 |
| 2009/0319261 | A1 | 12/2009 | Gupta et al. | |
| 2009/0326930 | A1 | 12/2009 | Kawashima et al. | |
| 2010/0023325 | A1* | 1/2010 | Bessette et al. | 704/219 |
| 2010/0057447 | A1* | 3/2010 | Ehara | 704/219 |
| 2011/0040567 | A1 | 2/2011 | Oh et al. | |
| 2011/0082693 | A1* | 4/2011 | Krishnan et al. | 704/225 |
| 2012/0072208 | A1* | 3/2012 | Krishnan et al. | 704/207 |

OTHER PUBLICATIONS

Vary P. et al., "Digital Speech Signal Processing" In: "Digital Speech Signal Processing", Jan. 1, 1998, Teubner, Suttgart, Germany, pp. 196-204, 209-219, 474-483, XP055096994, ISBN: 978-3-51-906165-6.

Taiwan Search Report—TW103101049—TIPO—Mar. 5, 2015.

International Search Report and Written Opinion—PCT/US2013/057864—ISA/EPO—Apr. 29, 2014.

* cited by examiner

SYSTEMS AND METHODS FOR DETERMINING PITCH PULSE PERIOD SIGNAL BOUNDARIES

RELATED APPLICATIONS

This application is related to and claims priority to U.S. Provisional Patent Application Ser. No. 61/767,470, filed Feb. 21, 2013, for "SYSTEMS AND METHODS FOR DETERMINING PITCH PULSE BOUNDARIES."

TECHNICAL FIELD

The present disclosure relates generally to electronic devices. More specifically, the present disclosure relates to systems and methods for determining pitch pulse period signal boundaries.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges arise in encoding, transmitting and decoding of audio signals. For example, an audio signal may be encoded in order to reduce the amount of bandwidth required to transmit the audio signal. When a portion of the audio signal is lost in transmission, it may be difficult to present an accurately decoded audio signal. As can be observed from this discussion, systems and methods that improve decoding may be beneficial.

SUMMARY

A method for determining pitch pulse period signal boundaries by an electronic device is described. The method includes obtaining a signal. The method also includes determining a first averaged curve based on the signal. The method further includes determining at least one first averaged curve peak position based on the first averaged curve and a threshold. The method additionally includes determining pitch pulse period signal boundaries based on the at least one first averaged curve peak position. The method also includes synthesizing a speech signal. The signal may be an excitation signal. The signal may be a temporary synthesized speech signal.

Determining the first averaged curve may include determining a sliding window average of the signal. The threshold may include a second averaged curve based on the first averaged curve. The method may include determining the second averaged curve by determining a sliding window average of the first averaged signal. Determining the at least one averaged curve peak position may include disqualifying one or more peaks of the first averaged curve that have less than a threshold number of samples beyond the threshold.

Determining the pitch pulse period signal boundaries may include designating a midpoint between a pair of first averaged curve peak positions as a pitch pulse period signal boundary.

The method may include determining an actual energy profile and a target energy profile based on the pitch pulse period signal boundaries and a temporary synthesized speech signal. Determining the target energy profile may include interpolating a previous frame end pitch pulse period energy and a current frame end pitch pulse period energy of the temporary synthesized speech signal.

The method may include determining a scaling factor based on the actual energy profile and the target energy profile. The method may include scaling an excitation signal based on the scaling factor to produce a scaled excitation signal.

An electronic device for determining pitch pulse period signal boundaries is also described. The electronic device includes pitch pulse period signal boundary determination circuitry that determines a first averaged curve based on a signal, determines at least one first averaged curve peak position based on the first averaged curve and a threshold, and determines pitch pulse period signal boundaries based on the at least one first averaged curve peak position. The electronic device also includes synthesis filter circuitry that synthesizes a speech signal.

A computer-program product for determining pitch pulse period signal boundaries is also described. The computer-program product includes a non-transitory tangible computer-readable medium with instructions. The instructions include code for causing an electronic device to obtain a signal. The instructions also include code for causing the electronic device to determine a first averaged curve based on the signal. The instructions further include code for causing the electronic device to determine at least one first averaged curve peak position based on the first averaged curve and a threshold. The instructions additionally include code for causing the electronic device to determine pitch pulse period signal boundaries based on the at least one first averaged curve peak position. The instructions also include code for causing the electronic device to synthesize a speech signal.

An apparatus for determining pitch pulse period signal boundaries is also described. The apparatus includes means for obtaining a signal. The apparatus also includes means for determining a first averaged curve based on the signal. The apparatus further includes means for determining at least one first averaged curve peak position based on the first averaged curve and a threshold. The apparatus additionally includes means for determining pitch pulse period signal boundaries based on the at least one first averaged curve peak position. The apparatus also includes means for synthesizing a speech signal.

DETAILED DESCRIPTION

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
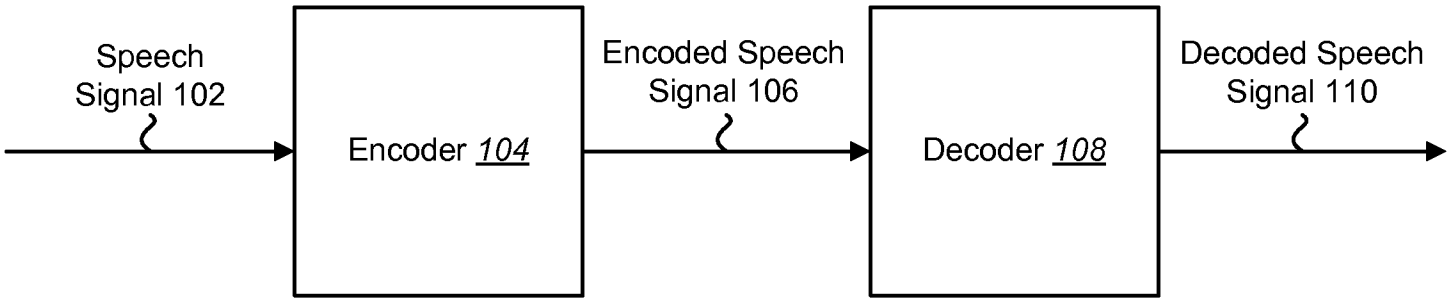
FIG. 1 is a block diagram illustrating a general example of an encoder and a decoder.

FIG. 1 is a block diagram illustrating a general example of an encoder 104 and a decoder 108. The encoder 104 receives a speech signal 102. The speech signal 102 may be a speech signal in any frequency range. For example, the speech signal 102 may be a superwideband signal with an approximate frequency range of 0-16 kilohertz (kHz), a wideband signal with an approximate frequency range of 0-8 kHz, a narrowband signal with an approximate frequency range of 0-4 kHz or a full band signal with an approximate frequency range (e.g., bandwidth) of 0-24 kHz. Other possible frequency ranges for the speech signal 102 include 300-3400 Hz (e.g., the frequency range of the Public Switched Telephone Network (PSTN)), 14-20 kHz, 16-20 kHz and 16-32 kHz. The systems and methods described herein may be applied to any bandwidth applicable in speech encoders. For example, the speech signal 102 may be sampled at 16 kHz in any frequency range.

The encoder 104 encodes the speech signal 102 to produce an encoded speech signal 106. In general, the encoded speech signal 106 includes one or more parameters that represent the speech signal 102. One or more of the parameters may be quantized. Examples of the one or more parameters include filter parameters (e.g., weighting factors, line spectral frequencies (LSFs), line spectral pairs (LSPs), immittance spectral frequencies (ISFs), immittance spectral pairs (ISPs), partial correlation (PARCOR) coefficients, reflection coefficients and/or log-area-ratio values, etc.) and parameters included in an encoded excitation signal (e.g., gain factors, adaptive codebook indices, adaptive codebook gains, fixed codebook indices and/or fixed codebook gains, etc.). The parameters may correspond to one or more frequency bands. The decoder 108 decodes the encoded speech signal 106 to produce a decoded speech signal 110. For example, the decoder 108 constructs the decoded speech signal 110 based on the one or more parameters included in the encoded speech signal 106. The decoded speech signal 110 may be an approximate reproduction of the original speech signal 102.

The encoder 104 may be implemented in hardware (e.g., circuitry), software or a combination of both. For example, the encoder 104 may be implemented as an application-specific integrated circuit (ASIC) or as a processor with instructions. Similarly, the decoder 108 may be implemented in hardware (e.g., circuitry), software or a combination of both. For example, the decoder 108 may be implemented as an application-specific integrated circuit (ASIC) or as a processor with instructions. The encoder 104 and the decoder 108 may be implemented on separate electronic devices or on the same electronic device.

In some configurations, the encoder 104 and/or decoder 108 may be included in a speech coding system where speech synthesis is done by passing an excitation signal through a synthesis filter to generate a synthesized speech output (e.g., the decoded speech signal 110). In such a system, an encoder 104 receives the speech signal 102, then windows the speech signal 102 to frames (e.g., 20 millisecond (ms) frames) and generates synthesis filter parameters and parameters required to generate the corresponding excitation signal. These parameters may be transmitted to the decoder 108 as an encoded speech signal 106. The decoder 108 may use these parameters to generate a synthesis filter (e.g., $1/A(z)$) and the corresponding excitation signal and may pass the excitation signal through the synthesis filter to generate the decoded speech signal 110. FIG. 1 may be a simplified block diagram of such a speech encoder/decoder system.

Figure 2:
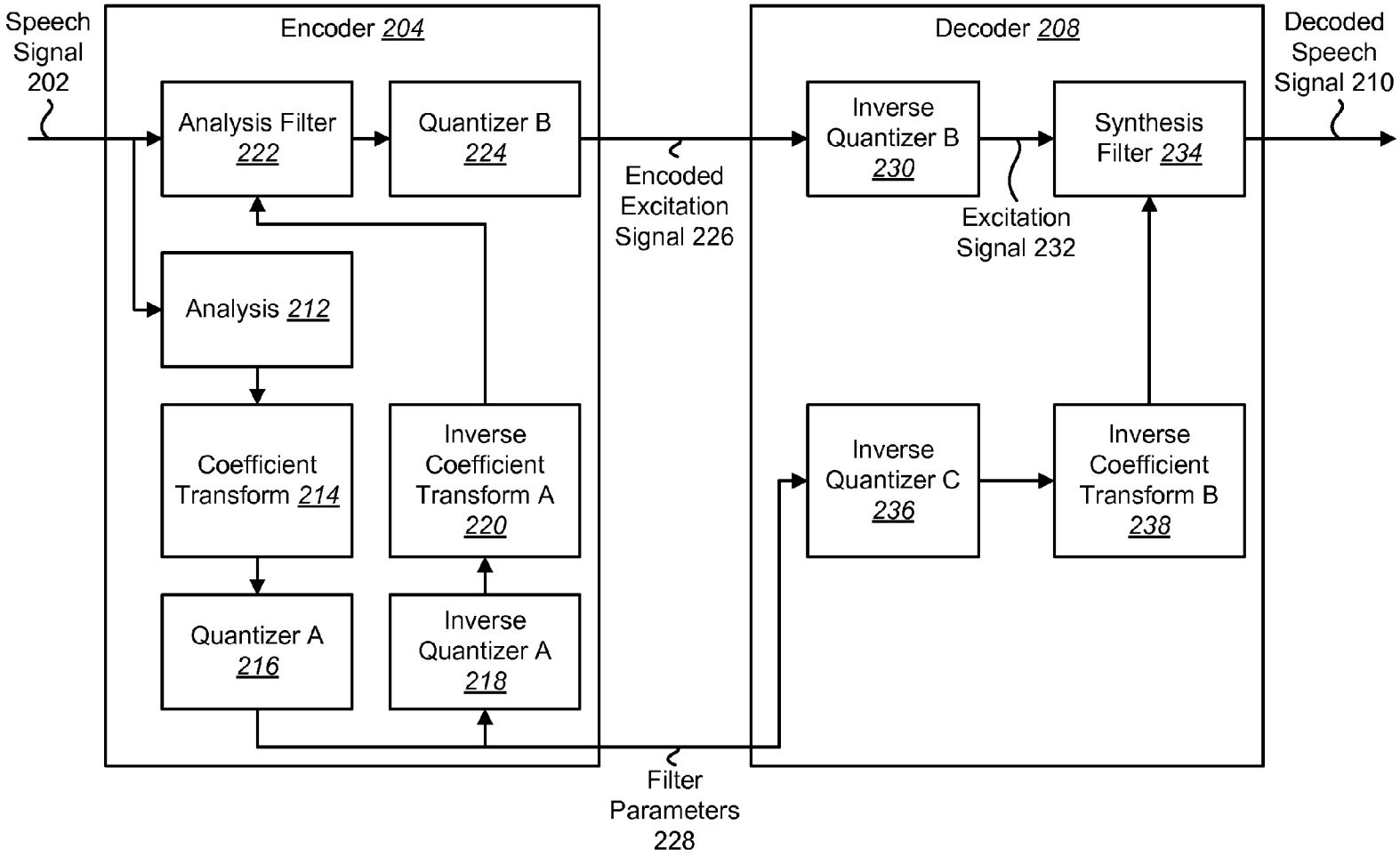
FIG. 2 is a block diagram illustrating an example of a basic implementation of an encoder and a decoder.

FIG. 2 is a block diagram illustrating an example of a basic implementation of an encoder 204 and a decoder 208. The encoder 204 may be one example of the encoder 104 described in connection with FIG. 1. The encoder 204 may include an analysis module 212, a coefficient transform 214, quantizer A 216, inverse quantizer A 218, inverse coefficient transform A 220, an analysis filter 222 and quantizer B 224. One or more of the components of the encoder 204 and/or decoder 208 may be implemented in hardware (e.g., circuitry), software or a combination of both.

The encoder 204 receives a speech signal 202. It should be noted that the speech signal 202 may include any frequency range as described above in connection with FIG. 1 (e.g., an entire band of speech frequencies or a subband of speech frequencies).

In this example, the analysis module 212 encodes the spectral envelope of a speech signal 202 as a set of linear prediction (LP) coefficients (e.g., analysis filter coefficients A(z), which may be applied to produce an all-pole synthesis filter 1/A(z), where z is a complex number). The analysis module 212 typically processes the input signal as a series of non-overlapping frames of the speech signal 202, with a new set of coefficients being calculated for each frame or subframe. In some configurations, the frame period may be a period over which the speech signal 202 may be expected to be locally stationary. One common example of the frame period is 20 ms (equivalent to 160 samples at a sampling rate of 8 kHz, for example). In one configuration, the analysis module 212 is configured to calculate a set of 10 linear prediction coefficients to characterize the formant structure of each 20-ms frame sampled at 8 kHz. It is also possible to implement the analysis module 212 to process the speech signal 202 as a series of overlapping frames.

The analysis module 212 may be configured to analyze the samples of each frame directly, or the samples may be weighted first according to a windowing function (e.g., a Hamming window). The analysis may also be performed over a window that is larger than the frame, such as a 30-ms window. This window may be symmetric (e.g., 5-20-5, such that it includes the 5 ms immediately before and after the 20-ms frame) or asymmetric (e.g., 10-20, such that it includes the last 10 ms of the preceding frame). The analysis module 212 is typically configured to calculate the linear prediction coefficients using a Levinson-Durbin recursion or the Leroux-Gueguen algorithm. In another implementation, the analysis module 212 may be configured to calculate a set of cepstral coefficients for each frame instead of a set of linear prediction coefficients.

The output rate of the encoder 204 may be reduced significantly, with relatively little effect on reproduction quality, by quantizing the coefficients. Linear prediction coefficients are difficult to quantize efficiently and are usually mapped into another representation, such as LSFs for quantization and/or entropy encoding. In the example of FIG. 2, the coefficient transform 214 transforms the set of coefficients into a corresponding LSF vector (e.g., set of LSF dimensions). Other one-to-one representations of coefficients include LSPs, PARCOR coefficients, reflection coefficients, log-area-ratio values, ISPs and ISFs. For example, ISFs may be used in the GSM (Global System for Mobile Communications) AMR-WB (Adaptive Multirate-Wideband) codec. For convenience, the term "line spectral frequencies," "LSFs," "LSF vectors" and related terms may be used to refer to one or more of LSFs, LSPs, ISFs, ISPs, PARCOR coefficients, reflection coefficients and log-area-ratio values. Typically, a transform between a set of coefficients and a corresponding LSF vector is reversible, but some configurations may include implementations of the encoder 204 in which the transform is not reversible without error.

Quantizer A 216 is configured to quantize the LSF vector (or other coefficient representation). The encoder 204 may output the result of this quantization as filter parameters 228. Quantizer A 216 typically includes a vector quantizer that encodes the input vector (e.g., the LSF vector) as an index to a corresponding vector entry in a table or codebook.

As seen in FIG. 2, the encoder 204 also generates a residual signal by passing the speech signal 202 through an analysis filter 222 (also called a whitening or prediction error filter) that is configured according to the set of coefficients. The analysis filter 222 may be implemented as a finite impulse response (FIR) filter or an infinite impulse response (IIR) filter. This residual signal will typically contain perceptually important information of the speech frame, such as long-term structure relating to pitch, that is not represented in the filter parameters 228. Quantizer B 224 is configured to calculate a quantized representation of this residual signal for output as an encoded excitation signal 226. In some configurations, quantizer B 224 includes a vector quantizer that encodes the input vector as an index to a corresponding vector entry in a table or codebook. Additionally or alternatively, quantizer B 224 may be configured to send one or more parameters from which the vector may be generated dynamically at the decoder 208, rather than retrieved from storage, as in a sparse codebook method. Such a method is used in coding schemes such as algebraic CELP (code-excited linear prediction) and codecs such as 3GPP2 (Third Generation Partnership 2) EVRC (Enhanced Variable Rate Codec). In some configurations, the encoded excitation signal 226 and the filter parameters 228 may be included in an encoded speech signal 106.

It may be beneficial for the encoder 204 to generate the encoded excitation signal 226 according to the same filter parameter values that will be available to the corresponding decoder 208. In this manner, the resulting encoded excitation signal 226 may already account to some extent for non-idealities in those parameter values, such as quantization error. Accordingly, it may be beneficial to configure the analysis filter 222 using the same coefficient values that will be available at the decoder 208. In the basic example of the encoder 204 as illustrated in FIG. 2, inverse quantizer A 218 dequantizes the filter parameters 228. Inverse coefficient transform A 220 maps the resulting values back to a corresponding set of coefficients. This set of coefficients is used to configure the analysis filter 222 to generate the residual signal that is quantized by quantizer B 224.

Some implementations of the encoder 204 are configured to calculate the encoded excitation signal 226 by identifying one among a set of codebook vectors that best matches the residual signal. It is noted, however, that the encoder 204 may also be implemented to calculate a quantized representation of the residual signal without actually generating the residual signal. For example, the encoder 204 may be configured to use a number of codebook vectors to generate corresponding synthesized signals (according to a current set of filter parameters, for example) and to select the codebook vector associated with the generated signal that best matches the original speech signal 202 in a perceptually weighted domain.

The decoder 208 may include inverse quantizer B 230, inverse quantizer C 236, inverse coefficient transform B 238 and a synthesis filter 234. Inverse quantizer C 236 dequantizes the filter parameters 228 (an LSF vector, for example), and inverse coefficient transform B 238 transforms the LSF vector into a set of coefficients (for example, as described above with reference to inverse quantizer A 218 and inverse coefficient transform A 220 of the encoder 204). Inverse quantizer B 230 dequantizes the encoded excitation signal 226 to produce an excitation signal 232. Based on the coefficients and the excitation signal 232, the synthesis filter 234 synthesizes a decoded speech signal 210. In other words, the synthesis filter 234 is configured to spectrally shape the excitation signal 232 according to the dequantized coefficients to produce the decoded speech signal 210. In some configurations, the decoder 208 may also provide the excitation signal 232 to another decoder, which may use the excitation signal 232 to derive an excitation signal of another frequency band (e.g., a highband). In some implementations, the decoder 208 may be configured to provide additional information to another decoder that relates to the excitation signal 232, such as spectral tilt, pitch gain and lag and speech mode.

The system of the encoder 204 and the decoder 208 is a basic example of an analysis-by-synthesis speech codec. Code-excited linear prediction coding is one popular family of analysis-by-synthesis coding. Implementations of such coders may perform waveform encoding of the residual, including such operations as selection of entries from fixed and adaptive codebooks, error minimization operations and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse excitation (MPE), multi-pulse CELP (MP-CELP), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10) (which uses residual excited linear prediction (RELP)), the GSM enhanced full rate codec (ETSI-GSM 06.60), the ITU (International Telecommunication Union) standard 11.8 kilobits per second (kbps) G.729 Annex E coder, the IS (Interim Standard)-641 codecs for IS-136 (a time-division multiple access scheme), the GSM adaptive multirate (GSM-AMR) codecs and the 4GV™ (Fourth-Generation Vocoder™) codec (QUALCOMM Incorporated, San Diego, Calif.). The encoder 204 and corresponding decoder 208 may be implemented according to any of these technologies, or any other speech coding technology (whether known or to be developed) that represents a speech signal as (A) a set of parameters that describe a filter and (B) an excitation signal used to drive the described filter to reproduce the speech signal.

Even after the analysis filter 222 has removed the coarse spectral envelope from the speech signal 202, a considerable amount of fine harmonic structure may remain, especially for voiced speech. Periodic structure is related to pitch, and different voiced sounds spoken by the same speaker may have different formant structures but similar pitch structures.

Coding efficiency and/or speech quality may be increased by using one or more parameter values to encode characteristics of the pitch structure. One important characteristic of the pitch structure is the frequency of the first harmonic (also called the fundamental frequency), which is typically in the range of 60 to 400 hertz (Hz). This characteristic is typically encoded as the inverse of the fundamental frequency, also called the pitch lag. The pitch lag indicates the number of samples in one pitch period and may be encoded as one or more codebook indices. Speech signals from male speakers tend to have larger pitch lags than speech signals from female speakers.

Another signal characteristic relating to the pitch structure is periodicity, which indicates the strength of the harmonic structure or, in other words, the degree to which the signal is harmonic or non-harmonic. Two typical indicators of periodicity are zero crossings and normalized autocorrelation functions (NACFs). Periodicity may also be indicated by the pitch gain, which is commonly encoded as a codebook gain (e.g., a quantized adaptive codebook gain).

The encoder 204 may include one or more modules configured to encode the long-term harmonic structure of the speech signal 202. In some approaches to CELP encoding, the encoder 204 includes an open-loop linear predictive coding (LPC) analysis module, which encodes the short-term characteristics or coarse spectral envelope, followed by a closed-loop long-term prediction analysis stage, which encodes the fine pitch or harmonic structure. The short-term characteristics are encoded as coefficients (e.g., filter parameters 228), and the long-term characteristics are encoded as values for parameters such as pitch lag and pitch gain. For example, the encoder 204 may be configured to output the encoded excitation signal 226 in a form that includes one or more codebook indices (e.g., a fixed codebook index and an adaptive codebook index) and corresponding gain values. Calculation of this quantized representation of the residual signal (e.g., by quantizer B 224, for example) may include selecting such indices and calculating such values. Encoding of the pitch structure may also include interpolation of a pitch prototype waveform, which operation may include calculating a difference between successive pitch pulses. Modeling of the long-term structure may be disabled for frames corresponding to unvoiced speech, which is typically noise-like and unstructured.

Some implementations of the decoder 208 may be configured to output the excitation signal 232 to another decoder (e.g., a highband decoder) after the long-term structure (pitch or harmonic structure) has been restored. For example, such a decoder may be configured to output the excitation signal 232 as a dequantized version of the encoded excitation signal 226. Of course, it is also possible to implement the decoder 208 such that the other decoder performs dequantization of the encoded excitation signal 226 to obtain the excitation signal 232.

Figure 3:
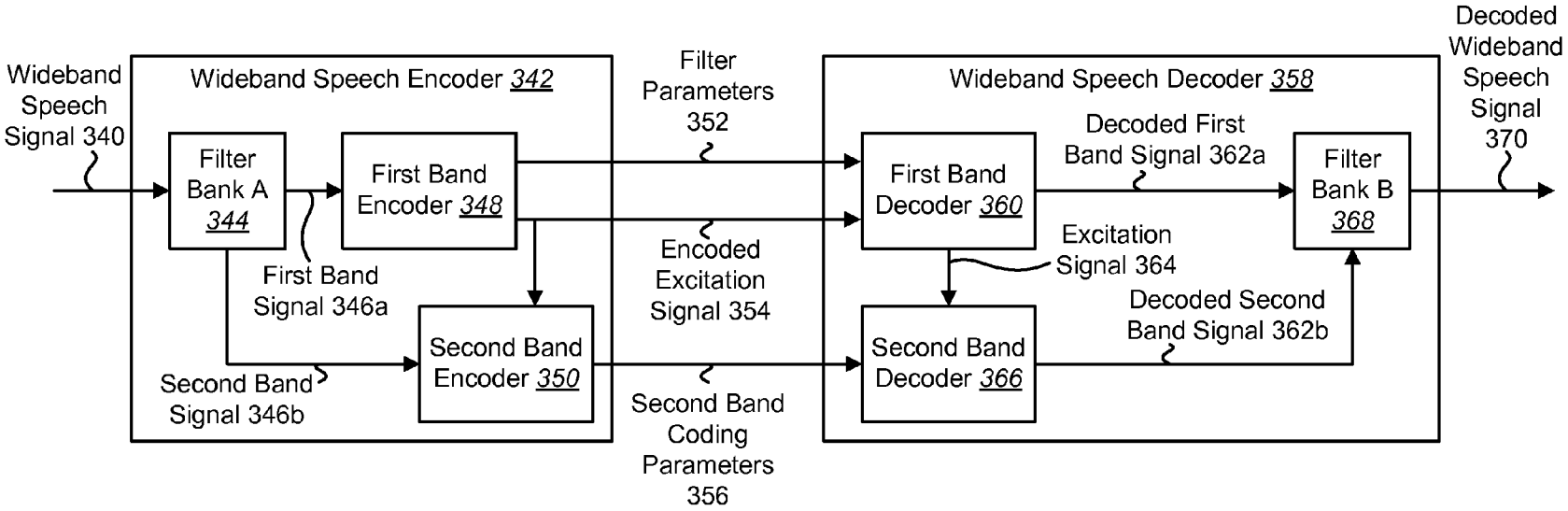
FIG. 3 is a block diagram illustrating an example of a wideband speech encoder and a wideband speech decoder.

FIG. 3 is a block diagram illustrating an example of a wideband speech encoder 342 and a wideband speech decoder 358. One or more components of the wideband speech encoder 342 and/or the wideband speech decoder 358 may be implemented in hardware (e.g., circuitry), software or a combination of both. The wideband speech encoder 342 and the wideband speech decoder 358 may be implemented on separate electronic devices or on the same electronic device.

The wideband speech encoder 342 includes filter bank A 344, a first band encoder 348 and a second band encoder 350. Filter bank A 344 is configured to filter a wideband speech signal 340 to produce a first band signal 346*a* (e.g., a narrowband signal) and a second band signal 346*b* (e.g., a highband signal).

The first band encoder 348 is configured to encode the first band signal 346*a* to produce filter parameters 352 (e.g., narrowband (NB) filter parameters) and an encoded excitation signal 354 (e.g., an encoded narrowband excitation signal). In some configurations, the first band encoder 348 may produce the filter parameters 352 and the encoded excitation signal 354 as codebook indices or in another quantized form. In some configurations, the first band encoder 348 may be implemented in accordance with the encoder 204 described in connection with FIG. 2.

The second band encoder 350 is configured to encode the second band signal 346*b* (e.g., a highband signal) according to information in the encoded excitation signal 354 to produce second band coding parameters 356 (e.g., highband coding parameters). The second band encoder 350 may be configured to produce second band coding parameters 356 as codebook indices or in another quantized form. One particular example of a wideband speech encoder 342 is configured to encode the wideband speech signal 340 at a rate of about 8.55 kbps, with about 7.55 kbps being used for the filter parameters 352 and encoded excitation signal 354, and about 1 kbps being used for the second band coding parameters 356. In some implementations, the filter parameters 352, the encoded excitation signal 354 and the second band coding parameters 356 may be included in an encoded speech signal 106.

In some configurations, the second band encoder 350 may be implemented similar to the encoder 204 described in connection with FIG. 2. For example, the second band encoder 350 may produce second band filter parameters (as part of the second band coding parameters 356, for instance) as described in connection with the encoder 204 described in connection with FIG. 2. However, the second band encoder 350 may differ in some respects. For example, the second band encoder 350 may include a second band excitation generator, which may generate a second band excitation signal based on the encoded excitation signal 354. The second band encoder 350 may utilize the second band excitation signal to produce a synthesized second band signal and to determine a second band gain factor. In some configurations, the second band encoder 350 may quantize the second band gain factor. Accordingly, examples of the second band coding parameters include second band filter parameters and a quantized second band gain factor.

It may be beneficial to combine the filter parameters 352, the encoded excitation signal 354 and the second band coding parameters 356 into a single bitstream. For example, it may be beneficial to multiplex the encoded signals together for transmission (e.g., over a wired, optical, or wireless transmission channel) or for storage, as an encoded wideband speech signal. In some configurations, the wideband speech encoder 342 includes a multiplexer (not shown) configured to combine the filter parameters 352, encoded excitation signal 354 and second band coding parameters 356 into a multiplexed signal. The filter parameters 352, the encoded excitation signal 354 and the second band coding parameters 356 may be examples of parameters included in an encoded speech signal 106 as described in connection with FIG. 1.

In some implementations, an electronic device that includes the wideband speech encoder 342 may also include circuitry configured to transmit the multiplexed signal into a transmission channel such as a wired, optical, or wireless channel. Such an electronic device may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, Transmission Control Protocol/Internet Protocol (TCP/IP), cdma2000, etc.).

It may be beneficial for the multiplexer to be configured to embed the filter parameters 352 and the encoded excitation signal 354 as a separable substream of the multiplexed signal, such that the filter parameters 352 and encoded excitation signal 354 may be recovered and decoded independently of another portion of the multiplexed signal such as a highband and/or lowband signal. For example, the multiplexed signal may be arranged such that the filter parameters 352 and encoded excitation signal 354 may be recovered by stripping away the second band coding parameters 356. One potential advantage of such a feature is to avoid the need for transcoding the second band coding parameters 356 before passing it to a system that supports decoding of the filter parameters 352 and encoded excitation signal 354 but does not support decoding of the second band coding parameters 356.

The wideband speech decoder 358 may include a first band decoder 360, a second band decoder 366 and filter bank B 368. The first band decoder 360 (e.g., a narrowband decoder) is configured to decode the filter parameters 352 and encoded excitation signal 354 to produce a decoded first band signal 362*a* (e.g., a decoded narrowband signal). The second band decoder 366 is configured to decode the second band coding parameters 356 according to an excitation signal 364 (e.g., a narrowband excitation signal) that is based on the encoded excitation signal 354 in order to produce a decoded second band signal 362*b* (e.g., a decoded highband signal). In this example, the first band decoder 360 is configured to provide the excitation signal 364 to the second band decoder 366. The filter bank 368 is configured to combine the decoded first band signal 362*a* and the decoded second band signal 362*b* to produce a decoded wideband speech signal 370.

Some implementations of the wideband speech decoder 358 may include a demultiplexer (not shown) configured to produce the filter parameters 352, the encoded excitation signal 354 and the second band coding parameters 356 from a multiplexed signal. An electronic device including the wideband speech decoder 358 may include circuitry configured to receive the multiplexed signal from a transmission channel such as a wired, optical or wireless channel. Such an electronic device may also be configured to perform one or more channel decoding operations on the signal, such as error correction decoding (e.g., rate-compatible convolutional decoding) and/or error detection decoding (e.g., cyclic redundancy decoding), and/or one or more layers of network protocol decoding (e.g., Ethernet, TCP/IP, cdma2000).

Filter bank A 344 in the wideband speech encoder 342 is configured to filter an input signal according to a split-band scheme to produce a first band signal 346*a* (e.g., a narrowband or low-frequency subband signal) and a second band signal 346*b* (e.g., a highband or high-frequency subband signal). Depending on the design criteria for the particular application, the output subbands may have equal or unequal bandwidths and may be overlapping or nonoverlapping. A configuration of filter bank A 344 that produces more than two subbands is also possible. For example, filter bank A 344 may be configured to produce one or more lowband signals that include components in a frequency range below that of the first band signal 346*a* (such as the range of 50-300 hertz (Hz), for example). It is also possible for filter bank A 344 to be configured to produce one or more additional highband signals that include components in a frequency range above that of the second band signal 346*b* (such as a range of 14-20, 16-20 or 16-32 kilohertz (kHz), for example). In such a configuration, the wideband speech encoder 342 may be implemented to encode the signal or signals separately and a multiplexer may be configured to include the additional encoded signal or signals in a multiplexed signal (as one or more separable portions, for example).

Figure 4:
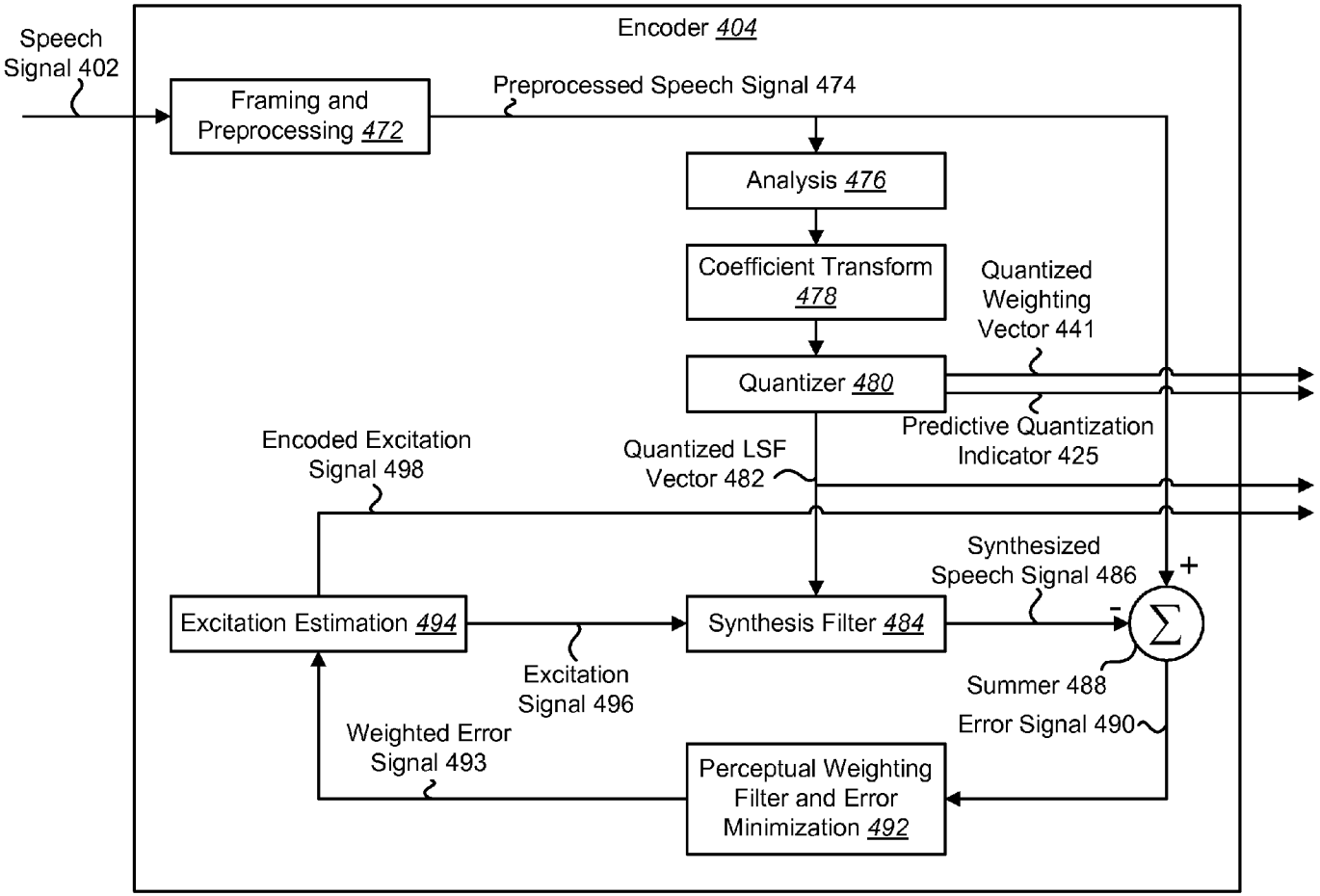
FIG. 4 is a block diagram illustrating a more specific example of an encoder.

FIG. 4 is a block diagram illustrating a more specific example of an encoder 404. In particular, FIG. 4 illustrates a CELP analysis-by-synthesis architecture for low bit rate speech encoding. In this example, the encoder 404 includes a framing and preprocessing module 472, an analysis module 476, a coefficient transform 478, a quantizer 480, a synthesis filter 484, a summer 488, a perceptual weighting filter and error minimization module 492 and an excitation estimation module 494. It should be noted that the encoder 404 and/or one or more of the components (e.g., modules) of the encoder 404 may be implemented in hardware (e.g., circuitry), software or a combination of both.

The speech signal 402 (e.g., input speech s) may be an electronic signal that contains speech information. For example, an acoustic speech signal may be captured by a microphone and sampled to produce the speech signal 402. In some configurations, the speech signal 402 may be sampled at 16 kHz. The speech signal 402 may comprise a range of frequencies as described above in connection with FIG. 1.

The speech signal 402 may be provided to the framing and preprocessing module 472. The framing and preprocessing module 472 may divide the speech signal 402 into a series of frames. Each frame may be a particular time period. For example, each frame may correspond to 20 ms of the speech signal 402. The framing and preprocessing module 472 may perform other operations on the speech signal, such as filtering (e.g., one or more of low-pass, high-pass and band-pass filtering). Accordingly, the framing and preprocessing module 472 may produce a preprocessed speech signal 474 (e.g., S(m), where m is a sample number) based on the speech signal 402.

The analysis module 476 may determine a set of coefficients (e.g., linear prediction analysis filter A(z)). For example, the analysis module 476 may encode the spectral envelope of the preprocessed speech signal 474 as a set of coefficients as described in connection with FIG. 2.

The coefficients may be provided to the coefficient transform 478. The coefficient transform 478 transforms the set of coefficients into a corresponding LSF vector (e.g., LSFs, LSPs, ISFs, ISPs, etc.) as described above in connection with FIG. 2.

The LSF vector is provided to the quantizer 480. The quantizer 480 quantizes the LSF vector into a quantized LSF vector 482. In some configurations, the quantized LSF vector 482 may be represented as an index (e.g., codebook index) that is sent to a decoder. The quantizer 480 may perform vector quantization on the LSF vector to yield the quantized LSF vector 482. This quantization can either be non-predictive (e.g., no previous frame LSF vector is used in the quantization process) or predictive (e.g., a previous frame LSF vector is used in the quantization process). In some configurations, the quantizer 480 may produce a predictive quantization indicator 425 that indicates whether predictive or non-predictive quantization is utilized for each frame. One example of the predictive quantization indicator 425 is a bit that indicates whether predictive or non-predictive quantization is utilized for a current frame. The predictive quantization indicator 425 may be sent to a decoder. In some configurations, LSF vectors may be generated and/or quantized on a subframe basis. In these configurations, only quantized LSF vectors corresponding to certain subframes (e.g., the last or end subframe of each frame) may be sent to a decoder. In some configurations, the quantizer 480 may also determine a quantized weighting vector 441. Weighting vectors may be used to quantize LSF vectors (e.g., mid LSF vectors) between LSF vectors corresponding to the subframes that are sent. The weighting vectors may be quantized. For example, the quantizer 480 may determine an index of a codebook or lookup table corresponding to a weighting vector that best matches the actual weighting vector. The quantized weighting vectors 441 (e.g., the indices) may be sent to a decoder. The quantized LSF vector 482, the predictive quantization indicator 425 and/or the quantized weighting vector 441 may be examples of the filter parameters 228 described above in connection with FIG. 2.

The quantized LSF vector 482 is provided to the synthesis filter 484. The synthesis filter 484 produces a synthesized speech signal 486 (e.g., reconstructed speech $\hat{s}(m)$, where m is a sample number) based on the quantized LSF vector 482 (e.g., coefficients) and an excitation signal 496. For example, the synthesis filter 484 filters the excitation signal 496 based on the quantized LSF vector 482 (e.g., 1/A(z)).

The synthesized speech signal 486 is subtracted from the preprocessed speech signal 474 by the summer 488 to yield an error signal 490 (also referred to as a prediction error signal). The error signal 490 may represent the error between the preprocessed speech signal 474 and its estimation (e.g., the synthesized speech signal 486). The error signal 490 is provided to the perceptual weighting filter and error minimization module 492.

The perceptual weighting filter and error minimization module 492 produces a weighted error signal 493 based on the error signal 490. For example, not all of the components (e.g., frequency components) of the error signal 490 impact the perceptual quality of a synthesized speech signal equally. Error in some frequency bands has a larger impact on the speech quality than error in other frequency bands. The perceptual weighting filter and error minimization module 492 may produce a weighted error signal 493 that reduces error in frequency components with a greater impact on speech quality and distributes more error in other frequency components with a lesser impact on speech quality.

The excitation estimation module 494 generates an excitation signal 496 and an encoded excitation signal 498 based on the output of the perceptual weighting filter and error minimization module 492. For example, the excitation estimation module 494 estimates one or more parameters that characterize the error signal 490 (e.g., weighted error signal 493). The encoded excitation signal 498 may include the one or more parameters and may be sent to a decoder. In a CELP approach, for example, the excitation estimation module 494 may determine parameters such as an adaptive (or pitch) codebook index, an adaptive (or pitch) codebook gain, a fixed codebook index and a fixed codebook gain that characterize the error signal 490. Based on these parameters, the excitation estimation module 494 may generate the excitation signal 496, which is provided to the synthesis filter 484. In this approach, the adaptive codebook index, the adaptive codebook gain (e.g., a quantized adaptive codebook gain), a fixed codebook index and a fixed codebook gain (e.g., a quantized fixed codebook gain) may be sent to a decoder as the encoded excitation signal 498.

The encoded excitation signal 498 may be an example of the encoded excitation signal 226 described above in connection with FIG. 2. Accordingly, the quantized LSF vector 482, the predictive quantization indicator 425, the encoded excitation signal 498 and/or the quantized weighting vector 441 may be included in an encoded speech signal 106 as described above in connection with FIG. 1.

Figure 5:
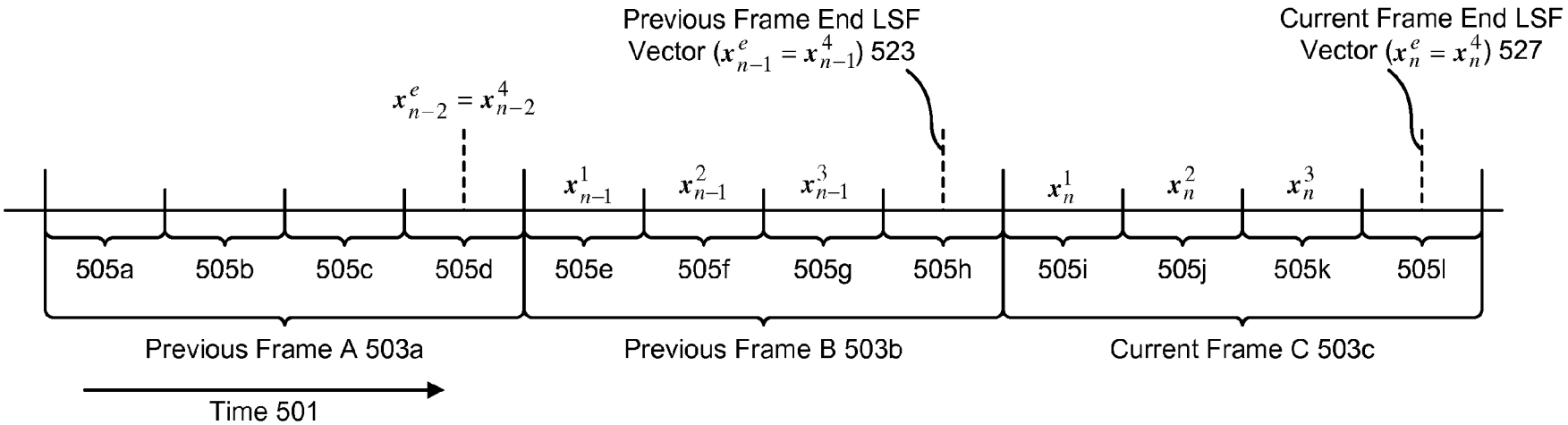
FIG. 5 is a diagram illustrating an example of frames over time.

FIG. 5 is a diagram illustrating an example of frames 503 over time 501. Each frame 503*a-c* (e.g., speech frame) is divided into a number of subframes 505. In the example illustrated in FIG. 5, previous frame A 503*a* includes 4 subframes 505*a-d*, previous frame B 503*b* includes 4 subframes 505*e-h* and current frame C 503*c* includes 4 subframes 505*i*–1. A typical frame 503 may occupy a time period of 20 ms and may include 4 subframes, though frames of different lengths and/or different numbers of subframes may be used. Each frame may be denoted with a corresponding frame number, where n denotes a current frame (e.g., current frame C 503*c*). Furthermore, each subframe may be denoted with a corresponding subframe number k.

FIG. 5 can be used to illustrate one example of LSF quantization in an encoder. Each subframe k in frame n has a corresponding LSF vector $x_n^k$, k={1, 2, 3, 4} for use in the analysis and synthesis filters. A current frame end LSF vector 527 (e.g., the last subframe LSF vector of the n-th frame) is denoted $x_n^e$, where $x_n^e = x_n^4$. One example of a previous frame end LSF vector 523 is illustrated in FIG. 5 and is denoted $X_{n-1}^e$ where $x_{n-1} = x_{n-1}^4$. As used herein, the term "previous frame" may refer to any frame before a current frame (e.g., n−1, n−2, n−3, etc.). Accordingly, a "previous frame end LSF vector" may be an end LSF vector corresponding to any frame before the current frame. In the example illustrated in FIG. 5, the previous frame end LSF vector 523 corresponds to the last subframe 505*h* of previous frame B 503*b* (e.g., frame n−1), which immediately precedes current frame C 503*c* (e.g., frame n).

Each LSF vector has a number of dimensions, where each dimension of the LSF vector corresponds to a single LSF dimension. For example, an LSF vector may typically have 16 dimensions for wideband speech (e.g., speech sampled at 16 kHz).

In some configurations, the LSF dimensions are transmitted to a decoder as synthesis filter parameters. For example, the encoder provides the current frame end LSF vector $x_n^e$ 527 for transmission to a decoder. The decoder may interpolate and/or extrapolate LSF vectors corresponding to one or more subframes 505 (e.g., subframes 505*i-k*) based on the current frame end LSF vector $x_n^e$ 527 and the previous frame end LSF vector $X_{n-1}^e$ 523. In some configurations, this interpolation/extrapolation may be based on a weighting vector.

It may be assumed that the encoder transmits information to the decoder through a frame erasure channel, where one or more frames may be erased frames (e.g., lost frames or packets). For example, assume that previous frame A 503*a* is correctly received and current frame C 503*c* is correctly received. If previous frame B 503*b* (e.g., frame n−1) is an erased frame, the decoder may estimate corresponding LSF vectors based on previous frame A 503*a* (e.g., frame n−2). As a result, the estimated LSF vectors (e.g., $x_{n-1}^1$, $x_{n-1}^2$, $x_{n-1}^3$, $x_{n-1}^4$, $x_n^1$, $x_n^2$, $X_n^3$ and possibly $x_n^4$ (if predictive LSF quantization techniques are used)) for several subframes may be different from the LSF vectors used in the encoder.

Figure 6:
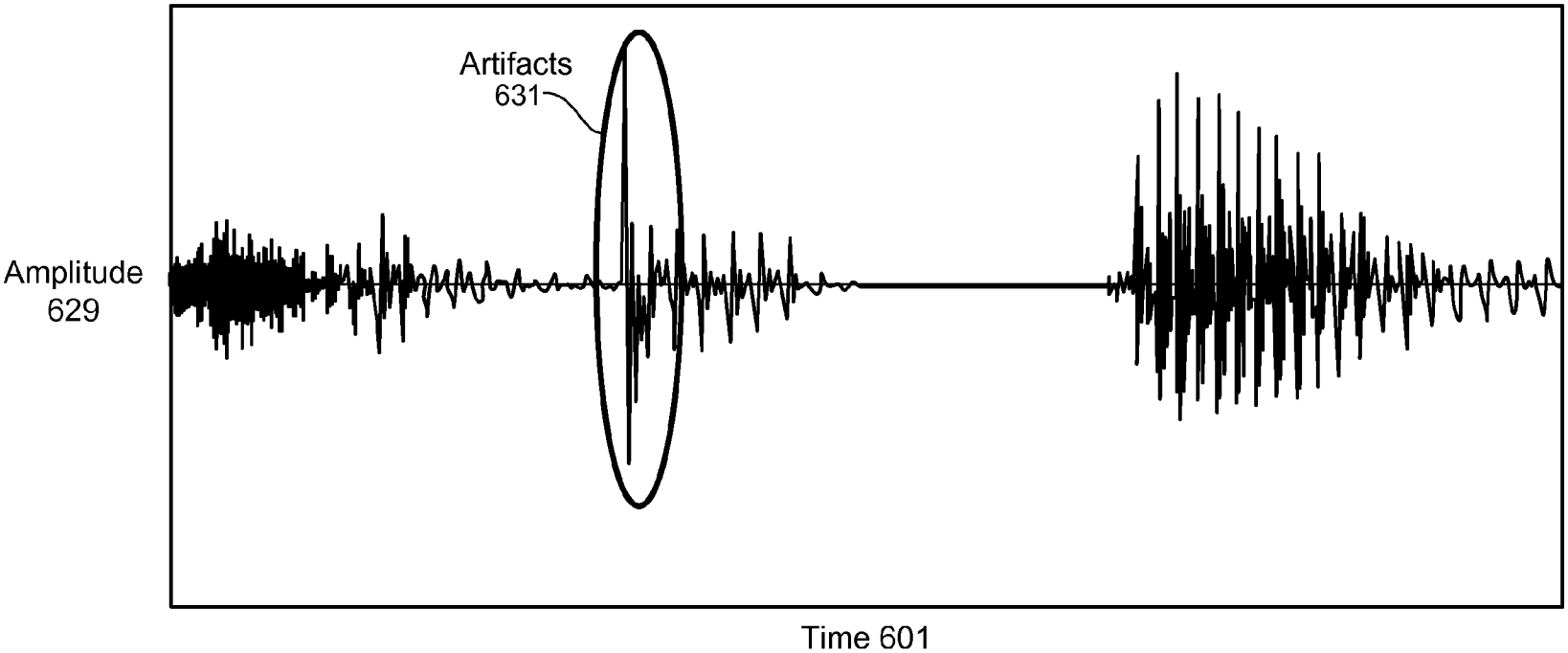
FIG. 6 is a graph illustrating an example of artifacts due to an erased frame.

FIG. 6 is a graph illustrating an example of artifacts 631 due to an erased frame. The horizontal axis of the graph is illustrated in time 601 (e.g., seconds) and the vertical axis of the graph is illustrated in amplitude 629. The amplitude 629 may be a number represented in bits. In some configurations, 16 bits may be utilized to represent a speech signal ranging in value between −32768 to 32767, which corresponds to a range (e.g., a value between −1 and +1 in floating point). It should be noted that the amplitude 629 may be represented differently based on the implementation. In some examples, the value of the amplitude 629 may correspond to an electromagnetic signal characterized by voltage (in volts) and/or current (in amps).

When the estimated LSF vectors in the decoder are not identical to the LSF vectors computed in the encoder, spectral peaks (e.g., the resonant frequencies of the resulting synthesis filter) can be present in the synthesis filter in the decoder that are not present in the synthesis filter estimated in the encoder. Passing a reconstructed excitation signal through the synthesis filter may result in a speech signal that exhibits higher energy spikes (e.g., annoying speech artifacts). More specifically, the graph given in FIG. 6 illustrates an example of artifacts 631 in a decoded speech signal (e.g., synthesized speech) that result from estimated LSF vectors being applied to a synthesis filter.

Figure 7:
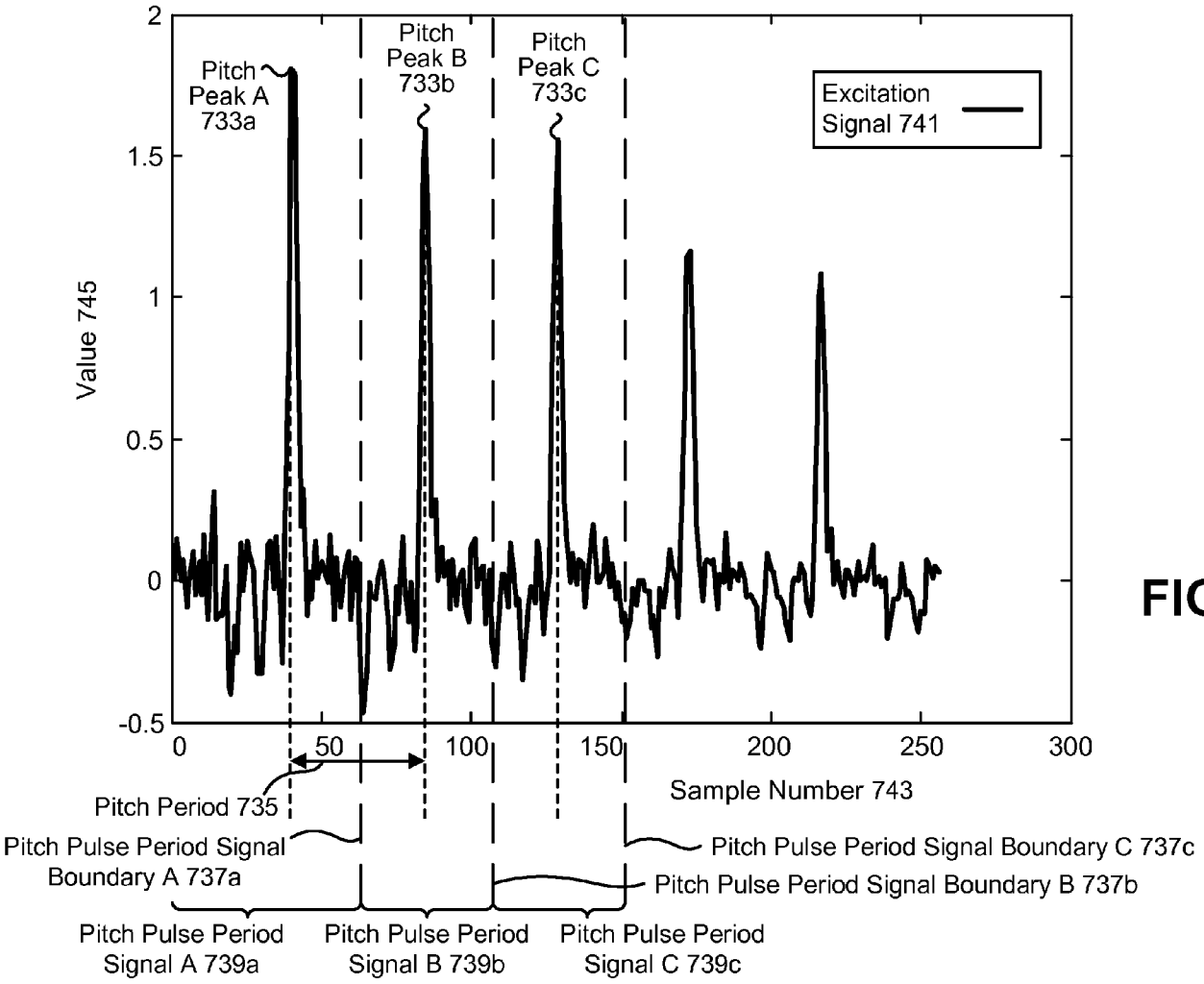
FIG. 7 is a graph that illustrates one example of an excitation signal.

FIG. 7 is a graph that illustrates one example of an excitation signal 741. The horizontal axis of the graph illustrates the sample number 743 of the excitation signal 741 and the vertical axis of the graph illustrates the value 745 of the excitation signal 741. In this example, the sampling rate is 12.8 kHz. In some configurations, the value 745 may be a number that can be represented by an electronic device or an electromagnetic signal. For example, the value 745 may be a binary number with a number of bits (e.g., 16, 32, etc., depending on the configuration of the electronic device). In another example, the value 745 may be a floating point number, which may have a very high dynamic range. The value 745 may correspond to a voltage or current that characterizes the excitation signal 741.

One component of a speech signal is pitch. Pitch is related to and can be expressed as the fundamental frequency of periodic oscillations exhibited by the speech signal. Accordingly, each periodic oscillation due to voice in a speech signal may be referred to as a pitch cycle. A pitch period is the length of a pitch cycle in time and may be expressed in units of time or samples. For example, a pitch period may be measured between pitch peaks. A pitch peak may be the largest absolute value in a pitch cycle due to voice (e.g., not due to noise or unvoiced sounds). Accordingly, a pitch peak may correspond to a local maximum or a local minimum in a pitch cycle. In some configurations, signals may be sampled in discrete-time intervals. In these configurations, the pitch peak may be the largest absolute value of a sample in a pitch cycle due to voice. A "pitch peak position" may be a time or sample number that corresponds to a pitch peak.

In the example illustrated in FIG. 7, the excitation signal 741 is based on a highly voiced speech signal. Accordingly, the excitation signal 741 exhibits several clearly distinguishable pitch peaks, including pitch peak A 733*a*, pitch peak B 733*b* and pitch peak C 733*c*. One example of a pitch period 735 is illustrated as measured between pitch peak A 733*a* and pitch peak B 733*b*.

A "pitch pulse" may be a limited number of samples around a pitch peak, where the absolute amplitude is relatively higher than the samples between the pitch peaks. For example, a pitch pulse is the collection of samples that create a pulse surrounding a pitch peak. As used herein, a "pitch pulse period signal" is a time segment of a signal that includes exactly one pitch peak. For example, a pitch pulse period signal may be a set of signal samples that includes exactly one pitch peak. The pitch peak may occur anywhere within a pitch pulse period signal. In some approaches, the pitch peak may be approximately located in the center of the pitch pulse period signal. FIG. 7 illustrates examples of pitch pulse period signals including pitch pulse period signal A 739*a*, pitch pulse period signal B 739*b* and pitch pulse period signal C 739*c*.

Pitch pulse period signals may be defined based on pitch pulse period signal boundaries. A pitch pulse period signal boundary is a time (e.g., sample) that separates pitch peaks. For example, a pitch pulse period signal boundary separates sets of samples, where each set includes a single pitch pulse period signal. In some approaches, pitch pulse period signal boundaries may be located at an approximate midpoint between pitch peaks (e.g., pitch peak positions). FIG. 7 illustrates examples of pitch pulse period signal boundaries including pitch pulse period signal boundary A 737*a*, pitch pulse period signal boundary B 737*b* and pitch pulse period signal boundary C 737*c*.

A pitch pulse period signal may be defined by and bounded by two pitch pulse period signal boundaries. For example, pitch pulse period signal B 739*b* is defined by and bounded by pitch pulse period signal boundary A 737*a* and pitch pulse period signal boundary B 737*b*. In some configurations, a frame (or subframe) boundary may be a pitch pulse period signal boundary. For example, assuming that the first sample of a frame (e.g., sample 1) is a frame boundary, pitch pulse period signal A 739*a* is defined by and bounded by the frame boundary and pitch pulse period signal boundary A 737*a*.

FIG. 7 illustrates an example of an excitation signal 741 based on a highly voiced speech signal and a corresponding pitch period 735. However, periodic structure is not always clearly distinguishable in a speech signal (or in an excitation signal based on a speech signal). Thus, determination of pitch peaks, pitch pulse period signals and/or pitch pulse period signal boundaries is not trivial in many instances. The systems and methods disclosed herein present a low complexity approach for determining pitch pulse period signal boundaries.

As described above, speech artifacts may occur in a decoded speech signal when one or more frame erasures occur. The systems and methods disclosed herein also include a pitch pulse period signal-based energy smoothing approach to ensure smooth evolution of speech in order to mitigate speech artifacts.

Energy smoothing may not be safely done on a subframe basis, since each subframe might contain a varying number of pitch peaks. For example, subframes might not encompass at least one pitch peak, which may result in amplifying signal segments between pitch peaks or attenuating pitch peaks unnecessarily. Thus, energy smoothing based on pitch pulse period signal boundaries may be employed in accordance with the systems and methods disclosed herein. For example, smoothly interpolating the speech energy between the last pitch pulse period signal of a previous frame and the last pitch pulse period signal of a current frame may reduce speech artifacts. For instance, one or more frame erasures may cause speech artifacts, which may be removed or reduced by energy smoothing based on pitch pulse period signals.

Figure 8:
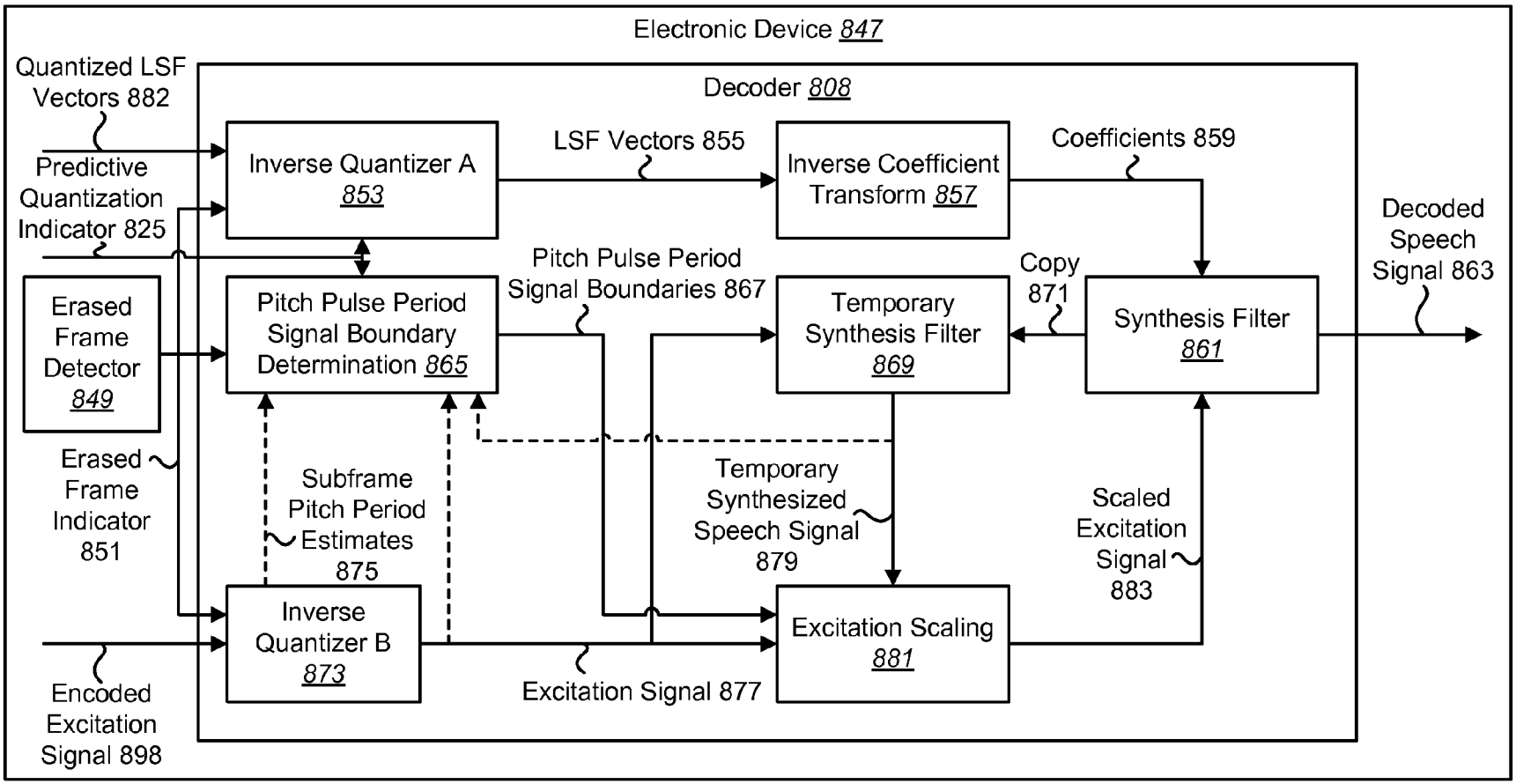
FIG. 8 is a block diagram illustrating one configuration of an electronic device configured for determining pitch pulse period signal boundaries.

FIG. 8 is a block diagram illustrating one configuration of an electronic device 847 configured for determining pitch pulse period signal boundaries. The electronic device 847 includes a decoder 808. One or more of the decoders described above may be implemented in accordance with the decoder 808 described in connection with FIG. 8. The electronic device 847 also includes an erased frame detector 849. The erased frame detector 849 may be implemented separately from the decoder 808 or may be implemented in the decoder 808. The erased frame detector 849 detects an erased frame (e.g., a frame that is not received or is received with errors) and may provide an erased frame indicator 851 when an erased frame is detected. For example, the erased frame detector 849 may detect an erased frame based on one or more of a hash function, checksum, repetition code, parity bit(s), cyclic redundancy check (CRC), etc.

It should be noted that one or more of the components included in the electronic device 847 and/or decoder 808 may be implemented in hardware (e.g., circuitry), software or a combination of both. For example, the pitch pulse period signal boundary determination module 865 and/or the excitation scaling module 881 may be implemented in hardware (e.g., circuitry), software or a combination of both. It should also be noted that arrows within blocks in FIG. 8 or other block diagrams herein may denote a direct or indirect coupling between components. For example, the pitch pulse period signal boundary determination module 865 may be coupled to the excitation scaling module 881.

The decoder 808 produces a decoded speech signal 863 (e.g., a synthesized speech signal) based on received parameters. Examples of the received parameters include quantized LSF vectors 882, quantized weighting vectors (not shown), a predictive quantization indicator 825 and an encoded excitation signal 898. The decoder 808 includes one or more of inverse quantizer A 853, an inverse coefficient transform 857, a synthesis filter 861, a pitch pulse period signal boundary determination module 865, a temporary synthesis filter 869, an excitation scaling module 881 and inverse quantizer B 873.

The decoder 808 receives quantized LSF vectors 882 (e.g., quantized LSFs, LSPs, ISFs, ISPs, PARCOR coefficients, reflection coefficients or log-area-ratio values). The received quantized LSF vectors 882 may correspond to a subset of subframes. For example, the quantized LSF vectors 882 may only include quantized end LSF vectors that correspond to the last subframe of each frame. In some configurations, the quantized LSF vectors 882 may be indices corresponding to a look up table or codebook.

When a frame is correctly received, inverse quantizer A 853 dequantizes the received quantized LSF vectors 882 to produce LSF vectors 855. For example, inverse quantizer A 853 may look up the LSF vectors 855 based on indices (e.g., the quantized LSF vectors 882) corresponding to a look up table or codebook. Dequantizing the quantized LSF vectors 882 may also be based on the predictive quantization indicator 825, which may indicate whether predictive or non-predictive quantization is utilized for a frame. In some configurations, the LSF vectors 855 may correspond to a subset of subframes (e.g., end LSF vectors $x_n^e$ corresponding to the last subframe of each frame). In some configurations, inverse quantizer A 853 may also interpolate LSF vectors to generate subframe LSF vectors. For example, inverse quantizer A 853 may interpolate a previous frame end LSF vector (e.g., $x_{n-1}^e$) and a current frame end LSF vector (e.g., $x_n^e$) n order to generate remaining subframe LSF vectors (e.g., subframe LSF vectors $x_n^k$ for the current frame).

When a frame is an erased frame, the erased frame detector 849 may provide an erased frame indicator 851 to inverse quantizer A 853. When an erased frame occurs, one or more quantized LSF vectors 882 may not be received or may contain errors. In this case, inverse quantizer A 853 may estimate one or more LSF vectors 855 (e.g., an end LSF vector of the erased frame $\hat{x}_n^e$) based on one or more LSF vectors from a previous frame (e.g., a frame before the erased frame).

The LSF vectors 855 may be provided to the inverse coefficient transform 857. The inverse coefficient transform 857 transforms the LSF vectors 855 into coefficients 859 (e.g., filter coefficients for a synthesis filter 1/A(z)). The coefficients 859 are provided to the synthesis filter 861.

The pitch pulse period signal boundary determination module 865 determines pitch pulse period signal boundaries 867 for one or more frames by performing one or more of the following operations. The pitch pulse period signal boundary determination module 865 may determine a first averaged curve based on a signal. An "averaged curve" is any curve or signal that is obtained by averaging, filtering and/or smoothing. For example, an "averaged curve" may be obtained by determining a moving average (e.g., sliding window average, simple moving average, central moving average, weighted moving average, etc.) of, filtering (e.g., low-pass filtering, band-pass filtering, etc.) and/or smoothing a signal. The first averaged curve may be determined based on an excitation signal 877, a temporary synthesized speech signal 879 and/or an adaptive codebook contribution.

In one example, determining the first averaged curve includes determining a sliding window average of the signal. More specifically, one example of the first averaged curve is an energy curve that is determined based on a sliding window as follows. For the current (e.g., n-th) frame, the energy of the signal inside a sliding window may be determined by selecting a window size and computing the total energy of the signal inside the window as given by Equation (1).

$$e_{i,n} = \sum_{j=i-\frac{N}{2}}^{i+\frac{N}{2}-1} X_{j,n}^2 \tag{1}$$

In Equation (1), $e_{i,n}$ is a total energy inside a window, where i is a sample number for a frame n. N is a window size (in samples). $X_{j,n}$ is a signal sample for the frame n, where j is a window sample number relative to the frame. For example, $X_{j,n}$ may be a sample of the excitation signal 877 or the temporary synthesized speech signal 879 in the frame n. In some configurations, j may extend outside of the frame n, where $X_{j,n}=0$ for $j \leq 0$ or $j>L$ and L is the length of the frame n. The energy curve may be determined by moving the window along the signal (e.g., X) and determining the total energy inside the window for each sample in the current frame. For example, moving the window may include computing $e_{i,n}$ $\forall i=\{1, 2, \ldots, L\}$.

In some configurations, the window size may be determined based on one or more subframe pitch period estimates 875. Current subframe pitch period estimates 875 may be transmitted by an encoder (e.g., an electronic device including the encoder) and received by a decoder (e.g., an electronic device including the decoder). For lost packets (e.g., erased frames), the subframe pitch period estimates 875 may be estimated based on a previous frame that was successfully received. The subframe pitch period estimates 875 may include a pitch period estimate for each subframe. For erased frames, the subframe pitch period estimates 875 may be determined (e.g., computed) based on a previous correctly received frame. The window size may be selected as $\alpha \cdot T_{p_min}$, where $T_{p_min}$ is a minimum subframe pitch period estimate of all the subframe pitch period estimates 875 corresponding to a frame. In some configurations, a may be selected between 0.4 and 0.6.

The energy curve resulting from the sliding window may include energy peaks that approximate (e.g., are close to) pitch peak positions of the signal (e.g., excitation signal 877 or temporary synthesized speech signal 879). It should be noted that the excitation signal 877 may exhibit clearer peaking than the temporary synthesized speech signal 879. For example, an energy curve based on the excitation signal 877 may exhibit clearer peaks than an energy curve based on the temporary synthesized speech signal 879.

The pitch pulse period signal boundary determination module 865 may determine at least one first averaged curve peak position based on the first averaged curve and a threshold. A first averaged curve peak position is a position in time (e.g., samples) of a peak in the first averaged curve. One or more first averaged curve peak positions may be determined by obtaining times (e.g., sample numbers) of the largest values of the first averaged curve beyond a threshold. In some configurations, a "largest value" that is "beyond a threshold" is greater than a positive threshold. In other configurations, a "largest value" that is "beyond a threshold" is less than a negative threshold. In some configurations, determining the at least one averaged curve peak position includes disqualifying one or more peaks. For example, the pitch pulse period signal boundary determination module 865 may disqualify one or more peaks of the first averaged curve that have less than a threshold number of samples beyond the threshold. In other words, only peaks that have at least the threshold number of samples beyond the threshold may qualify as first averaged curve peaks. In one approach, the number of samples for a peak may be the number of contiguous samples beyond the threshold that include the peak sample. The pitch pulse period signal boundary determination module 865 may determine whether this number of contiguous samples is equal to or greater than the threshold number of samples. Qualified first averaged curve peaks may more likely correspond to a pitch peak of the signal, while disqualified first averaged curve peaks are likely due to other speech components or noise. One or more peak positions corresponding to the qualified first averaged curve peaks may be designated as first averaged curve peak positions.

In some configurations, the threshold may be a fixed threshold. Utilizing a fixed threshold may introduce one or more false peaks and/or may miss one or more correct peaks.

In other configurations, the threshold may be a second averaged curve. The pitch pulse period signal boundary determination module 865 may determine the second averaged curve based on the first averaged curve. The second averaged curve may be obtained by averaging, filtering and/or smoothing. For example, the pitch pulse period signal boundary determination module 865 may determine the second averaged curve by determining a moving average (e.g., sliding window average, simple moving average, central moving average, weighted moving average, etc.) of, filtering (e.g., low-pass filtering, band-pass filtering, etc.) and/or smoothing the first averaged signal.

One example of determining first averaged curve peaks based on a second averaged curve is given as follows. A threshold curve is one example of the second averaged curve that may be used as the threshold to determine the peaks of the first averaged curve. In this example, the pitch pulse period signal boundary determination module 865 may determine the threshold curve based on a second sliding window as follows. For the current (e.g., n-th) frame, the threshold curve may be determined by selecting a second window size and computing the threshold value for the second window as given by Equation (2).

$$Threshold_{i,n} = \sum_{m=i-\frac{M}{2}}^{i+\frac{M}{2}-1} e_{m,n}^2 \tag{2}$$

In Equation (1), $Threshold_{i,n}$ is a threshold value for a second window, where i is a sample number for the current frame n. M is a second window size (in samples). $e_{m,n}$ is the energy curve for the current frame n (that may be determined in accordance with Equation (1), for example), where m is a second window sample number relative to the current frame. In some configurations, m may extend outside of the current frame n, where $e_{m,n}=0$ for $m \leq 0$ or $m>L$ and L is the length of the current frame n. The threshold curve may be determined by moving the second window along the energy curve and determining the threshold value for the second window for each value of the energy curve. For example, moving the second window may include computing $Threshold_{i,n}$ $\forall i=\{1, 2, \ldots, L\}$. In other words, the threshold curve may be obtained by iteratively determining (e.g., computing) the windowed energy curve $e_{i,n}$ obtained earlier. In some configurations, the second window size M may be selected as $\beta \cdot T_{p_min}$. In one example, β may be selected as 0.9.

The pitch pulse period signal boundary determination module 865 may determine one or more energy curve peaks (e.g., maximum values) that are greater than the threshold curve. The pitch pulse period signal boundary determination module 865 may then disqualify any of the one or more energy curve peaks with less than a threshold number of samples above the threshold curve. For example, an isolated energy curve peak may be disqualified if the number of samples representing the isolated peak above the threshold curve is less than a threshold number of samples. Peak positions corresponding to the remaining qualified energy curve peaks may be designated as energy curve peak positions.

The pitch pulse period signal boundary determination module 865 may determine pitch pulse period signal boundaries 867 based on the at least one first averaged curve peak position. In some configurations, the pitch pulse period signal boundary determination module 865 may designate one or more midpoints between one or more pairs of first averaged curve peak positions as one or more pitch pulse period signal boundaries 867. For example, if there is an odd number of samples between a pair of first averaged curve peak positions, the central sample between the pair of first averaged curve peak positions may be designated as a pitch pulse period signal boundary 867. If there is an even number of samples between a pair a first averaged curve peak positions, one of the two central samples between the pair of first averaged curve peak positions may be designated as a pitch pulse period signal boundary 867. For instance, the earlier of the two central samples may be designated as a pitch pulse period signal boundary 867 in one approach, while the later of the two central samples may be designated as a pitch pulse period signal boundary 867 in another approach. In some configurations, one or more frame (or subframe) boundaries may be designated as pitch pulse period signal boundaries 867. For example, one or more frame boundaries may be one or more pitch pulse period signal boundaries 867 for the initial and/or last first averaged curve peaks in a frame. For instance, the first sample in a frame may be a pitch pulse period signal boundary for the first averaged curve peak in a frame and the last sample in the frame may be a pitch pulse period signal boundary for the last averaged curve peak. In other configurations, frame boundaries may not be designated pitch pulse period signal boundaries.

The pitch pulse period signal boundary determination module 865 may provide the pitch pulse period signal boundaries 867 to the excitation scaling module 881. In some configurations, the pitch pulse period signal boundary determination module 865 may only operate when the erased frame indicator 851 indicates that an erased frame has occurred. For example, the pitch pulse period signal boundary determination module 865 may determine pitch pulse period signal boundaries 867 for an erased frame and for one or more frames after the erased frame (up to a certain number of correctly received frames or until a frame that utilizes non-predictive quantization is received, for instance). For example, the pitch pulse period signal boundaries 867 may be determined until a frame where the predictive quantization indicator 825 indicates that non-predictive quantization is utilized. In other configurations, the pitch pulse period signal boundary determination module 865 may operate for all frames. The approach for determining pitch pulse period signal boundaries 867 presented by the systems and methods disclosed herein is a low-complexity approach.

The approach described herein for utilizing pitch pulse period signal boundaries is highly robust. In particular, if a pitch pulse is missed, this approach still does not introduce artifacts in smoothing speech signals, even for speech frames that do not have a clear harmonic structure.

Inverse quantizer B 873 receives and dequantizes an encoded excitation signal 898 to produce an excitation signal 877. In one example, the encoded excitation signal 898 may include a fixed codebook index, a quantized fixed codebook gain, an adaptive codebook index and a quantized adaptive codebook gain. In this example, inverse quantizer B 873 looks up a fixed codebook entry (e.g., vector) based on the fixed codebook index and applies a dequantized fixed codebook gain to the fixed codebook entry to obtain a fixed codebook contribution. Additionally, inverse quantizer B 873 looks up an adaptive codebook entry based on the adaptive codebook index and applies a dequantized adaptive codebook gain to the adaptive codebook entry to obtain an adaptive codebook contribution. Inverse quantizer B 873 may then sum the fixed codebook contribution and the adaptive codebook contribution to produce the excitation signal 877.

The excitation signal 877 may be provided to a temporary synthesis filter 869 and an excitation scaling module 881. The temporary synthesis filter 869 may receive (and function as) a copy 871 of the synthesis filter 861. For example, the temporary synthesis filter 869 may be synthesis filter 861 memory that is copied into a temporary array. The temporary synthesis filter 869 generates the temporary synthesized speech signal 879 based on the excitation signal 877. For example, the temporary synthesized speech signal 879 may be generated by sending the excitation signal 877 through the temporary synthesis filter 869. The temporary synthesis filter 869 may be utilized in order to avoid updating the synthesis filter 861 memory. The temporary synthesized speech signal 879 may be provided to the excitation scaling module 881.

The excitation scaling module 881 may scale the excitation signal 877 for one or more frames based on pitch pulse period signal boundaries 867 and the temporary synthesized speech signal 879. For example, the excitation scaling module 881 may determine an actual energy profile and a target energy profile based on the pitch pulse period signal boundaries 867 and the temporary synthesized speech signal 879. The excitation scaling module 881 may also determine a scaling factor based on the actual energy profile and the target energy profile. The excitation scaling module 881 may scale the excitation signal 877 based on the scaling factor.

In some configurations, the excitation scaling module 881 may perform one or more of the following procedures in order to scale the excitation signal 877. The excitation scaling module 881 may determine pitch pulse period signal energies from the previous frame end pitch pulse period signal to the current frame end pitch pulse period signal as defined by the pitch pulse period signal boundaries 867. In some configurations, this may be accomplished in accordance with Equation (3).

$$E_p = \sum_{s=l_p}^{u_p} T_s^2 \tag{3}$$

In Equation (3), $E_p$ is the pitch pulse period signal energy for a pitch pulse period signal number p, $T_s$ is the temporary synthesized speech signal 879 at a sample number s, $l_p$ is a lower limit sample number for pitch pulse period signal number p and $u_p$ is an upper limit sample number for pitch pulse period signal number p. $p_{n-1}^e \le p \le p_n^e$, where $p_{n-1}^e$ is a pitch pulse period signal number for a last or "end" pitch pulse period signal of a previous frame n−1 and $p_n^e$ is a pitch pulse period signal number for a last or "end" pitch pulse period signal of the current frame n. In the case where pitch pulse period signal p is the last or "end" pitch pulse period signal in a frame, $l_p$ is a lower pitch pulse period signal boundary 867 of the pitch pulse period signal p and $u_p$ is the last sample in the frame. In the case where pitch pulse period signal p is the first pitch pulse period signal in a frame, $l_p$ is the first sample in the frame (e.g., a lower pitch pulse period signal boundary 867) and $u_p$ is the last sample of the pitch pulse period signal p. Otherwise, $l_p$ is a lower pitch pulse period signal boundary 867 and $u_p$ is the last sample of the pitch pulse period signal p. Accordingly, each boundary sample may only be included in the calculation of one pitch pulse period signal energy in some configurations. Other approaches may be utilized in other configurations.

The excitation scaling module 881 may determine pitch pulse period signal energies for each pitch pulse period signal from a previous frame end pitch pulse period signal to the current frame end pitch pulse period signal. For example, the excitation scaling module 881 may determine $E_p \forall p=\{p_{n-1}^e, \ldots, p_n^e\}$.

An actual energy profile may include the pitch pulse period signal energies of the temporary synthesized speech signal 879 for each pitch pulse period signal from a previous frame end pitch pulse period signal to the current frame end pitch pulse period signal. For example, the actual energy profile $E_{actual,p}=E_p$, where $p_{n-1}^e \leq p \leq p \leq_n^e$.

The excitation scaling module 881 may determine a target energy profile. For example, determining the target energy profile may include interpolating a previous frame end pitch pulse period signal energy and a current frame end pitch pulse period signal energy of the temporary synthesized speech signal 879.

In one example, the excitation scaling module 881 may determine the target energy profile by interpolating (e.g., linearly or non-linearly interpolating) pitch pulse period signal energy values between the previous frame end pitch pulse period signal energy $E_{n-1}^e$ and the current frame end pitch pulse period signal energy of $E_n^e$ of the temporary synthesized speech signal 879. For instance, $E_{n-1}^e=E_p$ for $p=p_{n-1}^e$ and $E_n^e=E_p$ for $p=p_n^e$. Examples of interpolation include linear interpolation, polynomial interpolation and spline interpolation. In some configurations, the interpolated pitch pulse period signal energy values may be located at the first averaged curve peak positions (e.g., energy curve peak positions) corresponding to each pitch pulse period signal between $p_{n-1}^e$ and $p_n^e$ in the current frame n. The target energy profile may be denoted $E_{target,p}$, where $p_{n-1}^e \leq p \leq p_n^e$.

The excitation scaling module 881 may determine a scaling factor based on the actual energy profile and the target energy profile. The scaling factor may include one or more scaling values that scale the actual energy profile to approximately match the target energy profile.

In one example, if the target energy profile for the p-th pitch pulse period signal is given by $E_{target,p}$ and the actual energy profile for the p-th pitch pulse period signal is given by $E_{actual,p}$, then the scaling factor may be determined in accordance with Equation (4).

$$g_p = \sqrt{\frac{E_{target,p}}{E_{actual,p}}} \tag{4}$$

In Equation (4), $g_p$ is a scaling value for the p-th pitch pulse period signal. In some configurations, the scaling factor may include all scaling values $g_p$ for $p=\{p_{n-1}^e, \ldots, p_n^e\}$.

The excitation scaling module 881 may scale the excitation signal 877 to produce a scaled excitation signal 883. The scaling may be based on the scaling factor. For example, the excitation signal $X_n$ in the current frame n may be scaled by $g_p$ for each pitch pulse period signal in the current frame (e.g., for $p=\{p_n^f, \ldots, p_n^e\}$, where $p_n^f$ is a pitch pulse period signal number corresponding to the first pitch pulse period signal in the current frame n). For instance, each set of samples in a pitch pulse period signal of the excitation signal 877 may be scaled by the scaling factor value for that pitch pulse period signal in the current frame. In some configurations, the excitation scaling module 881 may not scale samples corresponding to the end pitch pulse period signal of the current frame, since the scaling value for the end pitch pulse period signal may typically be 1.

In some configurations, the excitation scaling module 881 may only scale the excitation signal 877 for certain frames. For example, the excitation scaling module 881 may apply the scaling factor for a certain number of frames following an erased frame or until a frame that utilizes non-predictive quantization. Otherwise, the excitation scaling module 881 may not scale the excitation signal 877 or may apply a scaling factor of 1 to the excitation signal 877. For instance, the excitation scaling module 881 may operate based on the erased frame indicator 851 (e.g., may apply the scaling factor for one or more frames after an erased frame as indicated by the erased frame indicator 851).

The excitation scaling module 881 may provide the scaled excitation signal 883 to the synthesis filter 861. The synthesis filter 861 filters the scaled excitation signal 883 in accordance with the coefficients 859 to produce a decoded speech signal 863. For example, the poles of the synthesis filter 861 may be configured in accordance with the coefficients 859. The scaled excitation signal 883 is then passed through the synthesis filter 861 to produce the decoded speech signal 863 (e.g., a synthesized speech signal). It should be noted that the scaled excitation signal 883 may be passed through the synthesis filter 861 using the correct synthesis filter memory (and not through the temporary synthesis filter 869). The systems and methods disclosed herein may help to ensure that the decoded speech signal 863 has reduced artifacts when a frame erasure occurs.

Figure 9:
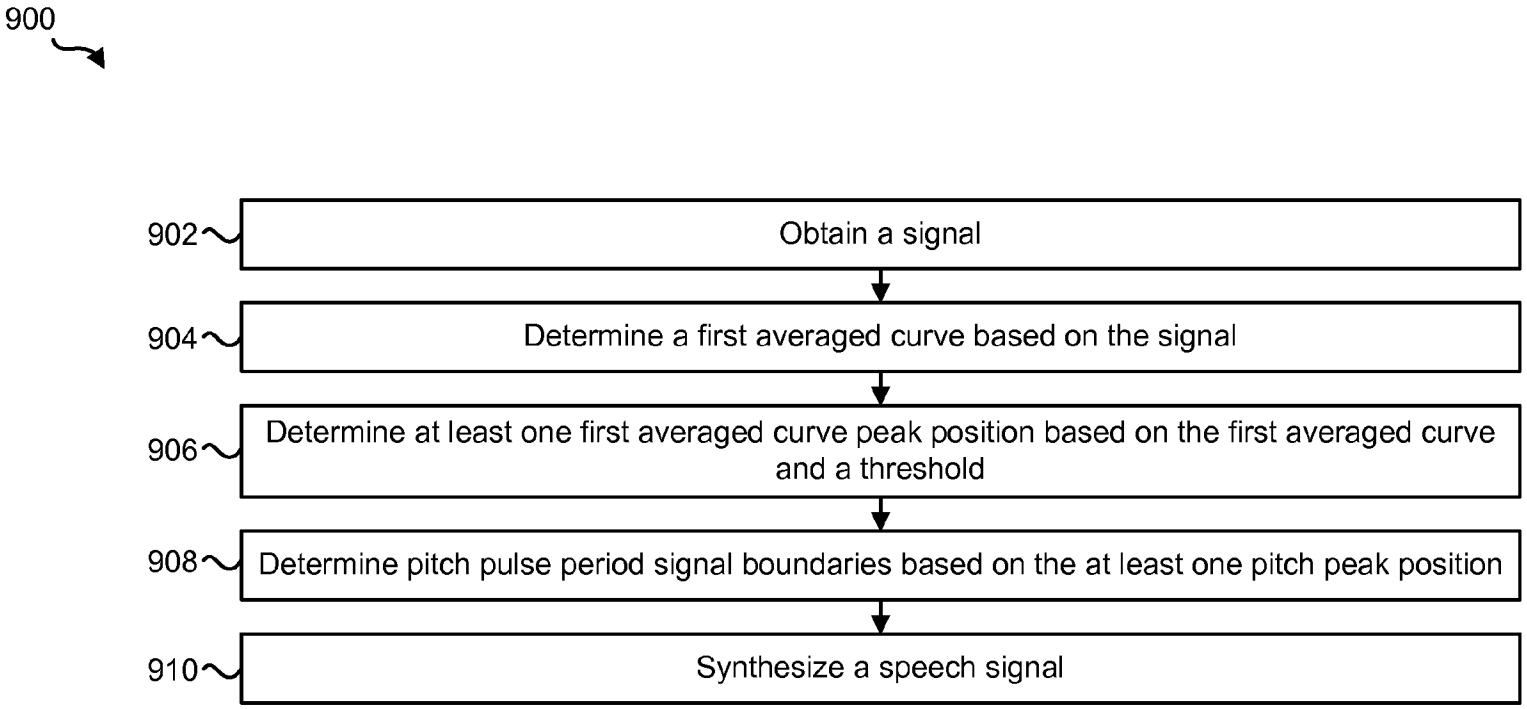
FIG. 9 is a flow diagram illustrating one configuration of a method for determining pitch pulse period signal boundaries.

FIG. 9 is a flow diagram illustrating one configuration of a method 900 for determining pitch pulse period signal boundaries. An electronic device 847 (e.g., decoder 808) may obtain 902 a signal. Examples of the signal include an excitation signal 877 and a temporary synthesized speech signal 879. For instance, the electronic device 847 may dequantize an encoded excitation signal 898 to obtain the excitation signal 877. Alternatively, the electronic device 847 may pass an excitation signal 877 through a temporary synthesis filter 869 to obtain the temporary synthesized speech signal 879.

The electronic device 847 may determine 904 a first averaged curve based on the signal. For example, the electronic device 847 may determine the first averaged curve by determining a moving average of, filtering and/or smoothing the signal as described above in connection with FIG. 8.

The electronic device 847 may determine 906 at least one first averaged curve peak position based on the first averaged curve and a threshold. For example, only peaks in the first averaged curve with at least a threshold number of samples above the threshold may qualify as first averaged curve peaks as described above in connection with FIG. 8. In some configurations, the threshold may be a second averaged curve that is based on the first averaged curve.

The electronic device 847 may determine 908 pitch pulse period signal boundaries 867 based on the at least one pitch peak position. For example, the electronic device 847 may determine 908 the pitch pulse period signal boundaries 867 by determining points (e.g., midpoints) between the first averaged curve peak positions and/or by designating one or more frame boundaries as pitch pulse period signal boundaries 867. This may be accomplished as described above in connection with FIG. 8.

The electronic device 847 may synthesize 910 a speech signal. For example, the electronic device 847 may scale an excitation signal 877 and pass the scaled excitation signal 883 through a synthesis filter 861 to obtain a decoded speech signal 863 as described above in connection with FIG. 8.

Figure 10:
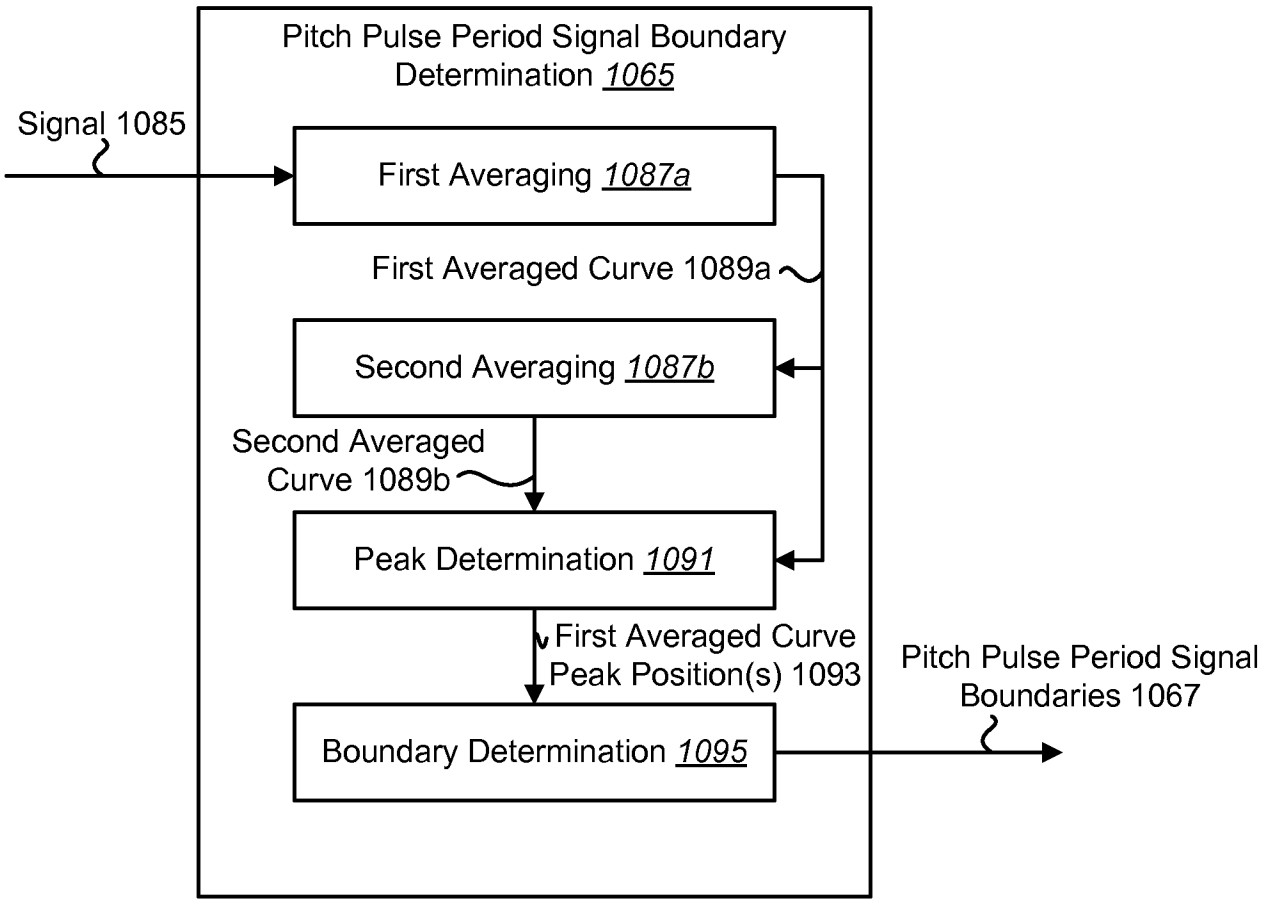
FIG. 10 is a block diagram illustrating one configuration of a pitch pulse period signal boundary determination module.

FIG. 10 is a block diagram illustrating one configuration of a pitch pulse period signal boundary determination module 1065. The pitch pulse period signal boundary determination module 1065 described in connection with FIG. 10 may be one example of the pitch pulse period signal boundary determination module 865 described in connection with FIG. 8. The pitch pulse period signal boundary determination module 865 and/or one or more components thereof may be implemented in hardware (e.g., circuitry), software or a combination of both.

The pitch pulse period signal boundary determination module 1065 includes a first averaging module 1087*a*, a second averaging module 1087*b*, a peak determination module 1091 and a boundary determination module 1095. The first averaging module 1087*a* performs moving averaging, filtering and/or smoothing on the signal 1085 to obtain a first averaged curve 1089*a* as described above. The second averaging module 1087*b* performs moving averaging, filtering and/or smoothing on the first averaged curve 1089*a* to obtain a second averaged curve 1089*b* as described above.

The peak determination module 1091 determines at least one first averaged curve peak position 1093 based on the first averaged curve 1089*a* and the second averaged curve 1089*b*. For example, the second averaged curve 1089*a* may be one example of a threshold. The peak determination module 1091 may determine one or more peak samples with a number of contiguous samples beyond the second averaged curve 1089*b* that is greater than or equal to a threshold number of samples. Position(s) of these one or more peak samples may be provided to the boundary determination module 1095 as the first averaged curve peak position(s) 1093. Other peak samples without a number of contiguous samples beyond the threshold number of samples may be disqualified. The threshold number of samples may depend on the sampling frequency. Typically, the threshold number of samples may be less than 18 (for a 16 kHz-sampled signal, for instance). For example, the threshold number of samples may be between 6-10 samples. In other examples, the threshold number of samples could be as low as 1 or 2, although this may not be desirable since this may not detect one or more false peaks. In yet other examples, the threshold number of samples could be approximately 16, which is less than 18, but may not be desirable since there may be one or more actual peaks with only 16 samples above the second averaged curve 1089*b* due to signal degradations such as noise.

The boundary determination module 1095 may determine pitch pulse period signal boundaries 1067 based on the first averaged curve peak position(s) 1093. For example, the pitch pulse period signal boundaries 1067 may include midpoints (e.g., central samples) between first averaged curve peak positions 1093 and/or frame boundaries as described above.

Figure 11:
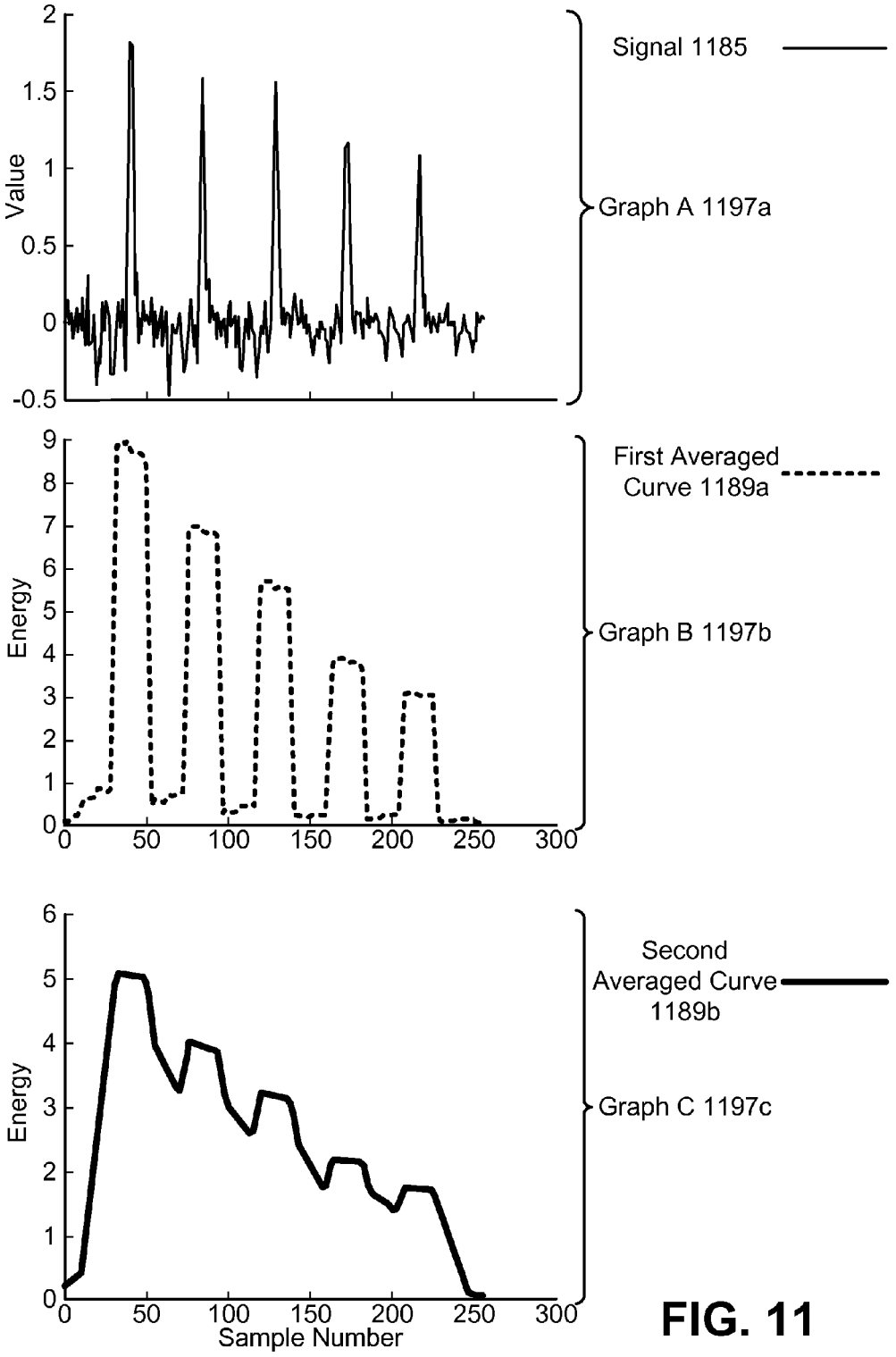
FIG. 11 includes graphs of examples of a signal, a first averaged curve and a second averaged curve.

FIG. 11 includes graphs 1197 of examples of a signal 1185, a first averaged curve 1189*a* and a second averaged curve 1189*b*. The vertical axis of graph A 1197*a* illustrates an amplitude value for each sample number. In some configurations, the amplitude value may correspond to a 16-bit number (which may represent a voltage (in volts) or a current (in amps) for an electrical signal). The vertical axis of graph B 1197*b* illustrates a first average (in energy or sum of square sample values, for example). It should be noted that, in general, the sum of squared samples may be referred to as "energy," although no units may be given. For an analog signal, for example, energy can be given in units of Joules (J) by integrating the area under the signal. However, in a discrete signal, a direct unit of energy may not be given. The vertical axis of graph C 1197*c* illustrates a second average (in energy or sum of square sample values, for example). The horizontal axes of graph A 1197*a*, graph B 1197*b* and graph C 1197*c* are illustrated in sample numbers.

Graph A 1197*a* illustrates one example of a signal 1185. In this example, the signal 1185 is an excitation signal corresponding to a highly voiced speech signal. Accordingly, the signal 1185 includes several clearly distinguishable pitch peaks.

Graph B 1197*b* illustrates one example of a first averaged curve 1189*a*. In this example, the first averaged curve 1189*a* is an energy curve based on the signal 1185. For instance, a first averaging module 1087*a* may apply a sliding window in accordance with Equation (1) to produce the first averaged curve 1189*a*.

Graph C 1197*c* illustrates one example of a second averaged curve 1189*b*. In this example, the second averaged curve 1189*b* is a threshold curve based on the first averaged curve 1189*a*. For instance, a second averaging module 1087*b* may apply a sliding window in accordance with Equation (2) to produce the second averaged curve 1189*b*.

Figure 12:
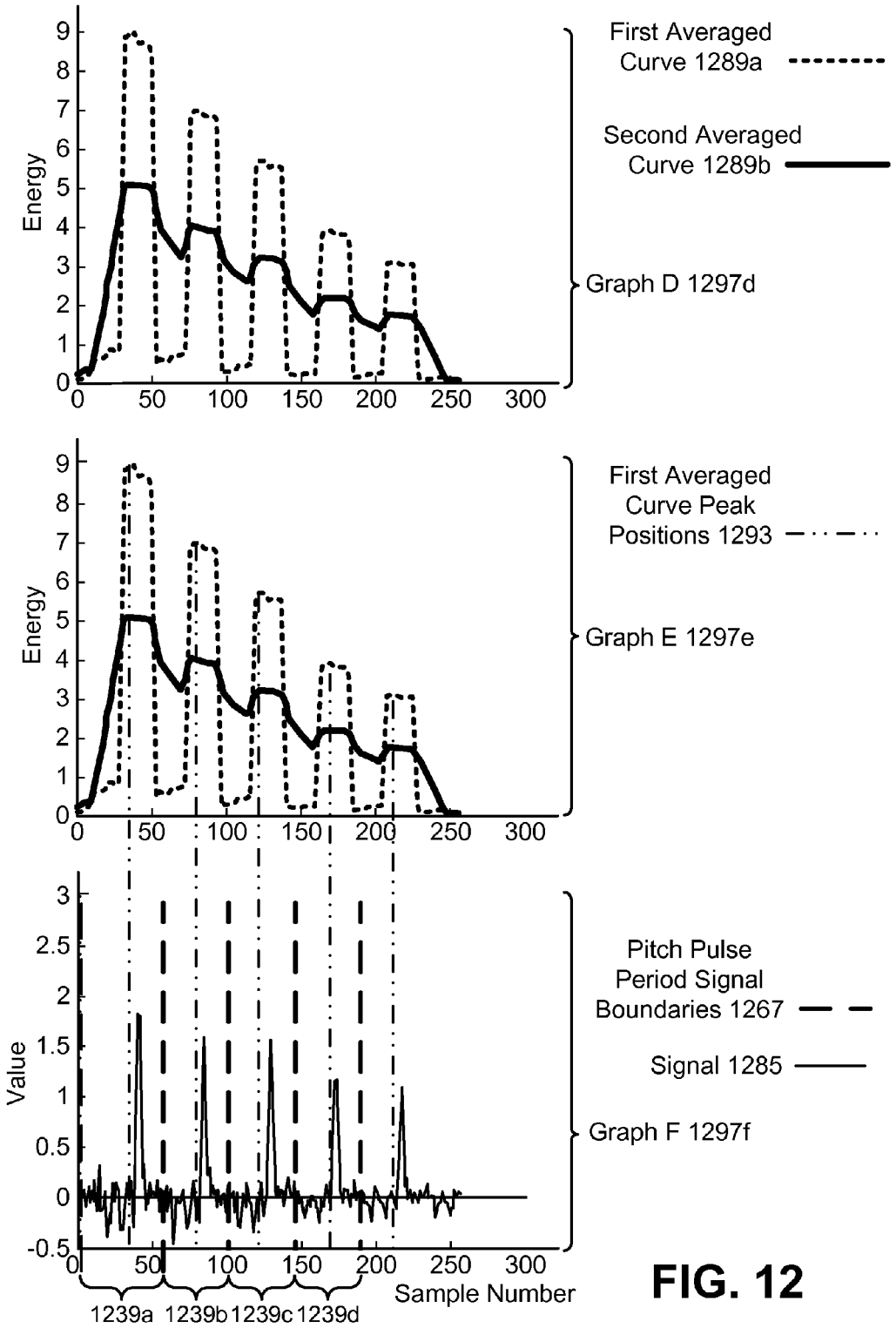
FIG. 12 includes graphs of examples of thresholding, first averaged curve peak positions and pitch pulse period signal boundaries.

FIG. 12 includes graphs 1297 of examples of thresholding, first averaged curve peak positions 1293 and pitch pulse period signal boundaries 1267. The vertical axes of graph D 1297*d* and graph E 1297*e* illustrate energy. The vertical axis of graph F 1297*f* illustrates amplitude value (e.g., a 16-bit representation of a voltage or current). The horizontal axes of graph D 1297*d*, graph E 1297*e* and graph F 1297*f* are illustrated in sample numbers. The first averaged curve 1289*a*, the second averaged curve 1289*b* and the signal 1285 described in connection with FIG. 12 correspond to the first averaged curve 1189*a*, the second averaged curve 1189*b* and the signal 1185 described in connection with FIG. 11, respectively.

Graph D 1297*d* illustrates one example of thresholding the first averaged curve 1289*a* with the second averaged curve 1289*b*. For example, the peak determination module 1091 may use the second averaged curve 1289*b* as a threshold for the first averaged curve 1289*a*. In particular, graphs D and E 1297*d-e* illustrate a difference between the first averaged curve 1289*a* and the second averaged curve 1289*b*.

Graph E 1297*e* illustrates examples of first averaged curve peak positions 1293. For example, the peak determination module 1091 may determine the first averaged curve peak positions 1293 as each maximum value (e.g., each maximum peak sample) in a contiguous set of samples above the second averaged curve 1289*b*, where the number of contiguous samples is equal to or greater than a threshold number of samples. FIG. 12 illustrates that the first averaged curve peak positions 1293 approximate pitch peak positions of the signal 1285.

Graph F 1297*f* illustrates examples of pitch pulse period signal boundaries 1267. For example, the boundary determination module 1095 may determine the pitch pulse period signal boundaries 1267 as the midpoints between each pair of first averaged curve peak positions 1293. Additionally, the boundary determination module 1095 may designate the first sample in the frame (e.g., sample 1) as a pitch pulse period signal boundary 1267.

As illustrated in FIG. 12, the pitch pulse period signal boundaries 1267 define pitch pulse period signals 1239*a-d* of the signal 1285, where each pitch pulse period signal 1239*a-d* includes exactly one pitch peak. A last pitch pulse period signal boundary is not illustrated in FIG. 12 for convenience. However, it should be noted that the last sample of the frame may be designated as a pitch pulse period signal boundary, which may define the end pitch pulse period signal in the frame together with another pitch pulse period signal boundary.

Figure 13:
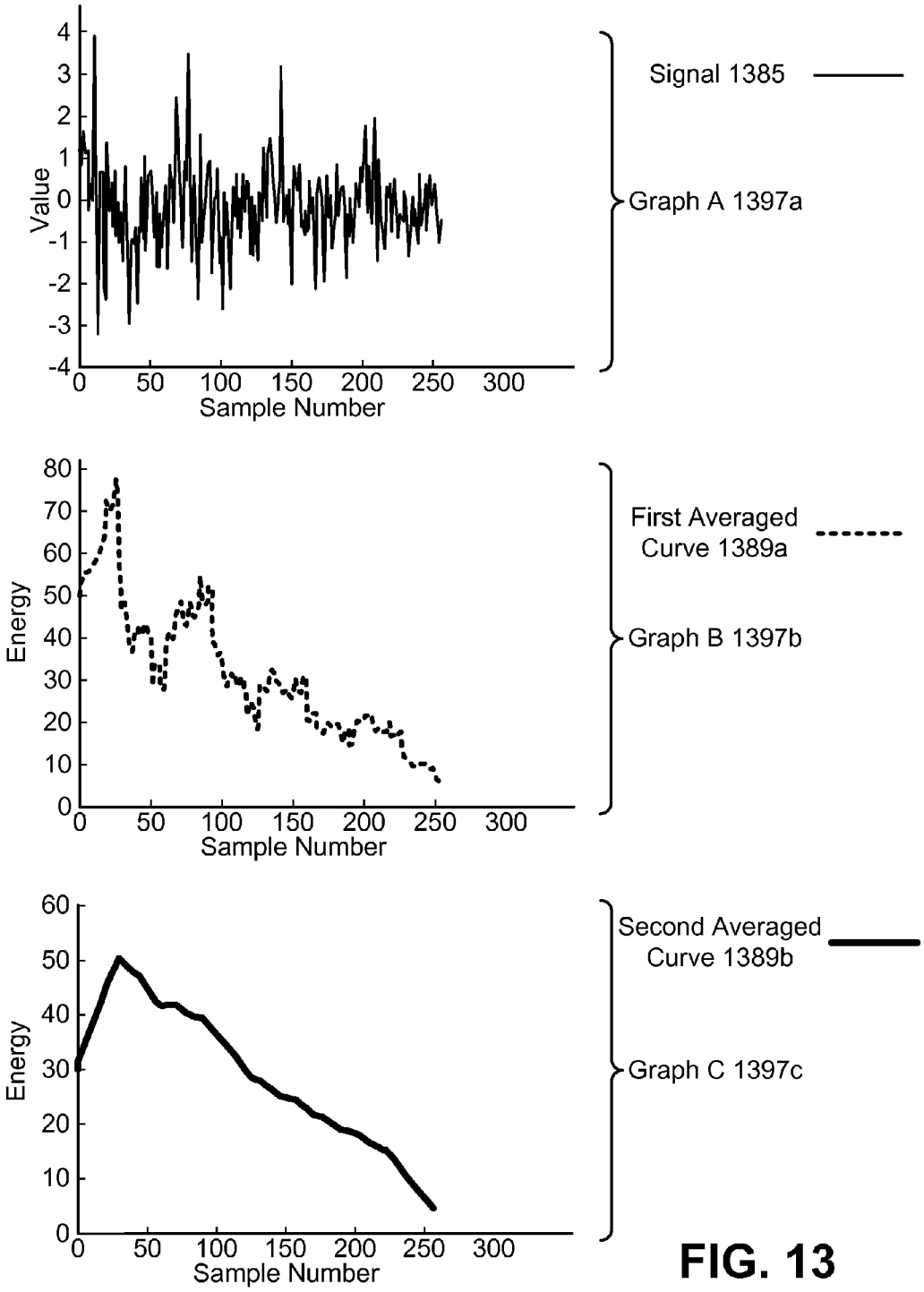
FIG. 13 includes graphs of examples of a signal, a first averaged curve and a second averaged curve.

FIG. 13 includes graphs 1397 of examples of a signal 1385, a first averaged curve 1389*a* and a second averaged curve 1389*b*. The vertical axis of graph A 1397*a* illustrates an amplitude value for each sample number. The vertical axis of graph B 1397*b* illustrates a first average (in energy or sum of square sample values, for example). The vertical axis of graph C 1397*c* is illustrates a second average (in energy or sum of square sample values, for example). The horizontal axes of graph A 1397*a*, graph B 1397*b* and graph C 1397*c* are illustrated in sample numbers.

Graph A 1397*a* illustrates one example of a signal 1385. In this example, the signal 1385 is an excitation signal corresponding to a speech signal that is not highly voiced. Accordingly, pitch peaks of the signal 1385 are not as clearly distinguishable as in a highly voiced speech signal.

Graph B 1397*b* illustrates one example of a first averaged curve 1389*a*. In this example, the first averaged curve 1389*a* is an energy curve based on the signal 1385. For instance, a first averaging module 1087*a* may apply a sliding window in accordance with Equation (1) to produce the first averaged curve 1389*a*.

Graph C 1397*c* illustrates one example of a second averaged curve 1389*b*. In this example, the second averaged curve 1389*b* is a threshold curve based on the first averaged curve 1389*a*. For instance, a second averaging module 1087*b* may apply a sliding window in accordance with Equation (2) to produce the second averaged curve 1389*b*.

Figure 14:
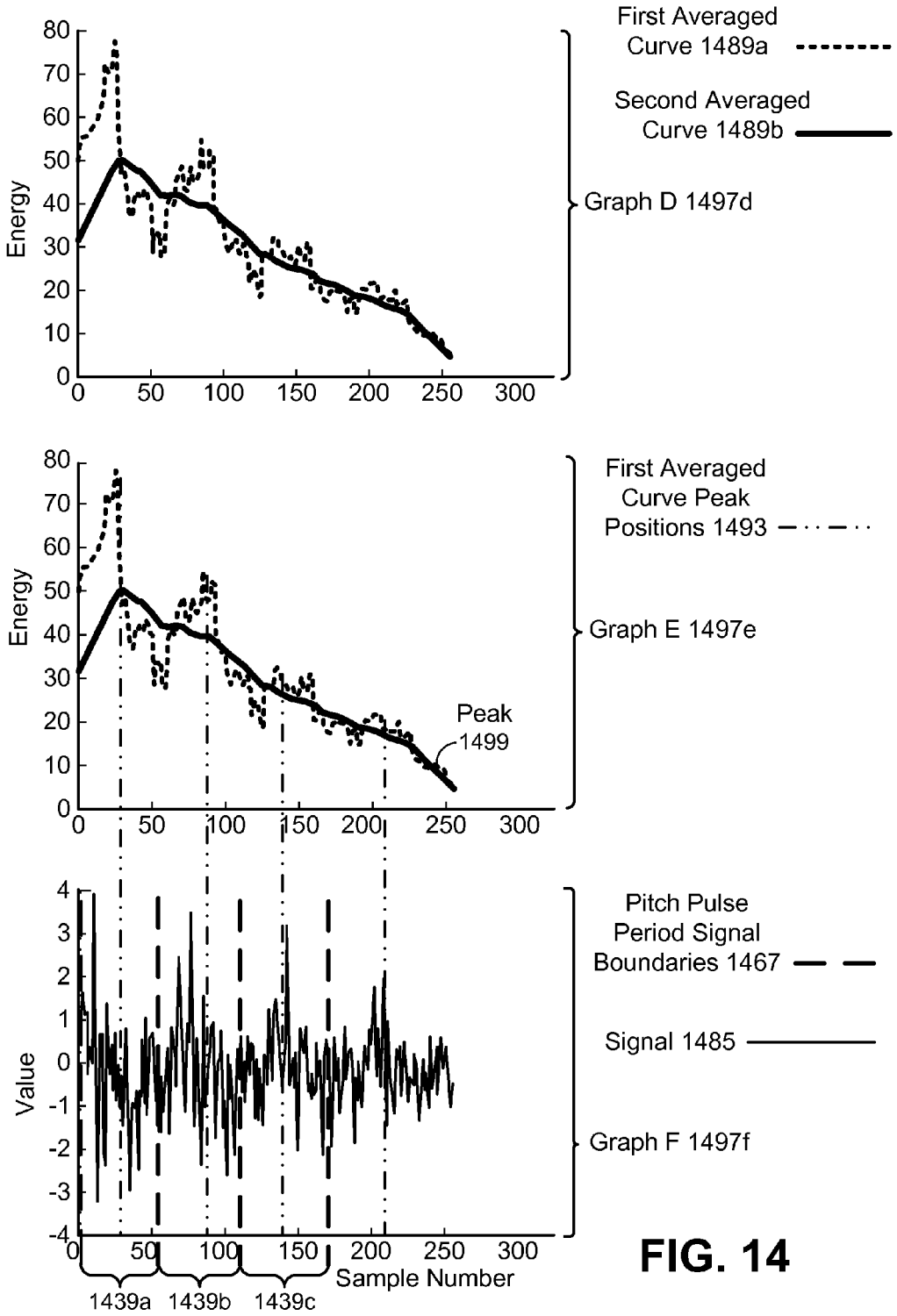
FIG. 14 includes graphs of examples of thresholding, first averaged curve peak positions and pitch pulse period signal boundaries.

FIG. 14 includes graphs 1497 of examples of thresholding, first averaged curve peak positions 1493 and pitch pulse period signal boundaries 1467. The vertical axes of graph D 1497*d* and graph E 1497*e* illustrate energy. The vertical axis of graph F 1497*f* illustrates amplitude (e.g., a 16-bit representation of a voltage or current). The horizontal axes of graph D 1497*d*, graph E 1497*e* and graph F 1497*f* are illustrated in sample numbers. The first averaged curve 1489*a*, the second averaged curve 1489*b* and the signal 1485 described in connection with FIG. 14 correspond to the first averaged curve 1389*a*, the second averaged curve 1389*b* and the signal 1385 described in connection with FIG. 13, respectively.

Graph D 1497*d* illustrates one example of thresholding the first averaged curve 1489*a* with the second averaged curve 1489*b*. For example, the peak determination module 1091 may use the second averaged curve 1489*b* as a threshold for the first averaged curve 1489*a*. In particular, graphs D and E 1497*d-e* illustrate a difference between the first averaged curve 1489*a* and the second averaged curve 1489*b*.

Graph E 1497*e* illustrates examples of first averaged curve peak positions 1493. For example, the peak determination module 1091 may determine the first averaged curve peak positions 1493 as each maximum value (e.g., each maximum peak sample) in a contiguous set of samples above the second averaged curve 1489*b*, where the number of contiguous samples is equal to or greater than a threshold number of samples. Graph E 1497*e* also illustrates one example of a disqualified peak 1499. In this case, the peak 1499 is in a set of contiguous samples (of the first averaged curve 1489*a*) above the second averaged curve 1489*b* that has less than a threshold number of samples. Accordingly, the peak determination module 1091 may designate the peak 1499 as a disqualified peak 1499. Therefore, the peak position of the disqualified peak 1499 is not used to determine pitch pulse period signal boundaries 1467.

Graph F 1497*f* illustrates examples of pitch pulse period signal boundaries 1467. For example, the boundary determination module 1095 may determine the pitch pulse period signal boundaries 1467 as the midpoints between each pair of first averaged curve peak positions 1493. Additionally, the boundary determination module 1095 may designate the first sample in the frame (e.g., sample 1) as a pitch pulse period signal boundary 1467.

As illustrated in FIG. 14, the pitch pulse period signal boundaries 1467 define pitch pulse period signals 1439*a-c* of the signal 1485, where each pitch pulse period signal 1439*a-c* includes exactly one pitch peak. A last pitch pulse period signal boundary is not illustrated in FIG. 14 for convenience. However, it should be noted that the last sample of the frame may be designated as a pitch pulse period signal boundary, which may define the end pitch pulse period signal in the frame together with another pitch pulse period signal boundary.

Figure 15:
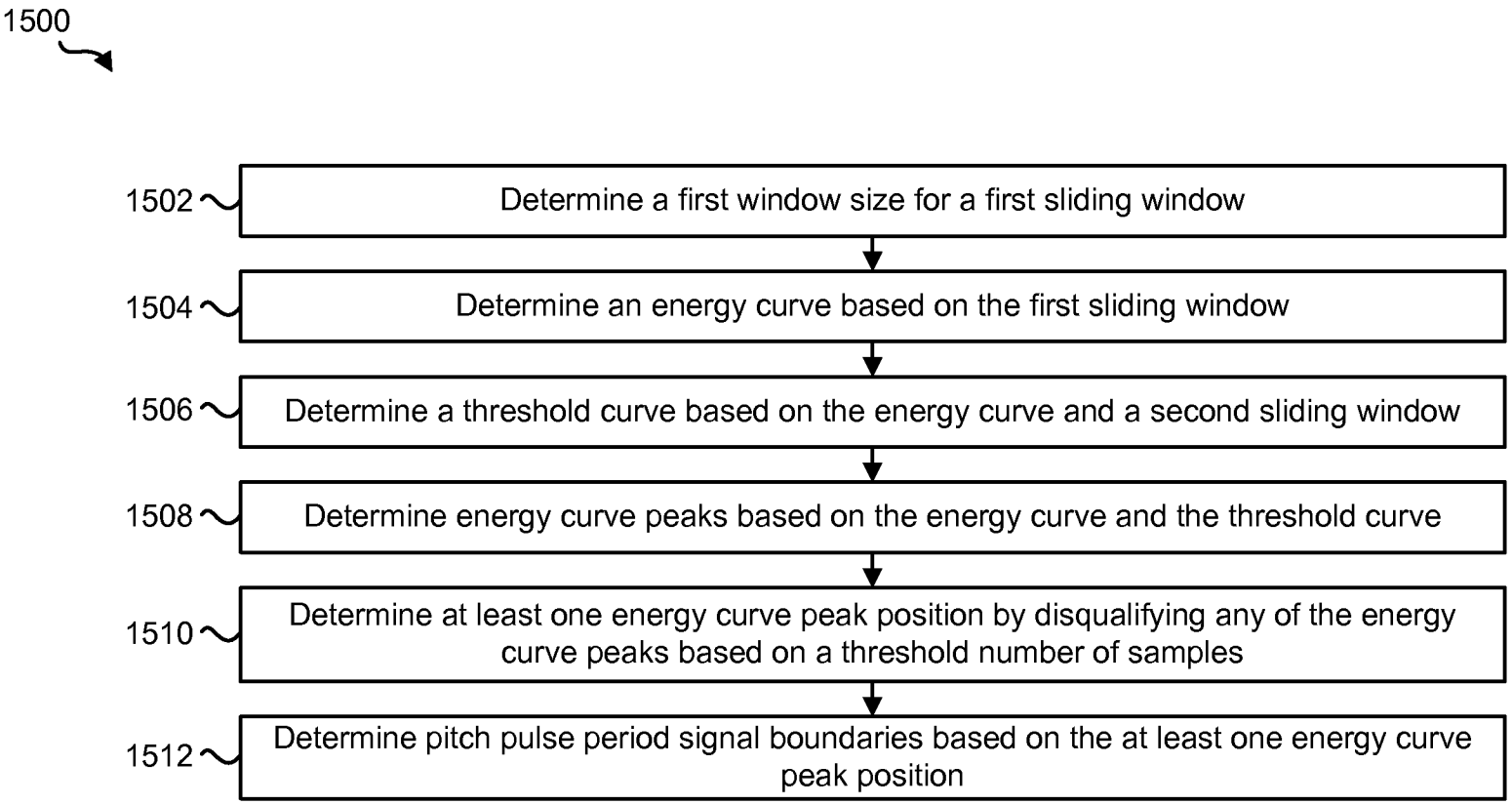
FIG. 15 is a flow diagram illustrating a more specific configuration of a method for determining pitch pulse period signal boundaries.

FIG. 15 is a flow diagram illustrating a more specific configuration of a method 1500 for determining pitch pulse period signal boundaries. An electronic device 847 may determine 1502 a first window size for a first sliding window. For example, the electronic device 847 may obtain subframe pitch period estimates 875 corresponding to each subframe of a frame. The electronic device 847 may determine a minimum subframe pitch period estimate with a minimum number of samples (e.g., $T_{p_min}$). The electronic device 847 may multiply the minimum subframe pitch period estimate by a first factor (e.g., $\alpha$). The first factor may be between 0.4 and 0.6. In some cases, the product of the minimum subframe pitch period estimate and the first factor (e.g., $\alpha \cdot T_{p_min}$) may be rounded to the nearest integer, integer floor or integer ceiling to obtain the first window size (e.g., N). For example, $N=\alpha \cdot T_{p_min}$ rounded to the nearest integer, $N=\lfloor \alpha \cdot T_{p_min} \rfloor$ or $N=\lceil \alpha \cdot T_{p_min} \rceil$.

The electronic device 847 may determine 1504 an energy curve based on the first sliding window. For example, the electronic device 847 may apply the first sliding window to a signal to determine $e_{i,n}$ $\forall i=\{1, 2, \ldots, L\}$ in accordance with Equation (1).

The electronic device 847 may determine 1506 a threshold curve based on the energy curve and a second sliding window. For example, the electronic device 847 may determine a second window size by multiplying the minimum subframe pitch period estimate (e.g., $T_{p_min}$) by a second factor (e.g., $\beta$). The second factor may be 0.9. A larger window size may provide a smoother curve that can be used as a threshold for the first curve. In some cases, the product of the minimum subframe pitch period estimate and the second factor (e.g., $\beta \cdot T_{p_min}$) may be rounded to the nearest integer, integer floor or integer ceiling to obtain the second window size (e.g., M). For example, $M=\beta \cdot T_{p_min}$ rounded to the nearest integer, $M=\lfloor \beta \cdot T_{p_min} \rfloor$ or $M=\lceil \beta \cdot T_{p_min} \rceil$. The electronic device 847 may apply the second sliding window to the energy curve to determine the threshold curve (e.g., $\text{Threshold}_{i,n}$ $\forall i=\{1, 2, \ldots, L\}$) in accordance with Equation (2).

The electronic device 847 may determine 1508 energy curve peaks based on the energy curve and the threshold curve. In one approach, the electronic device 847 determines one or more sets of contiguous samples that are greater than the threshold curve. A set of contiguous samples may be a series of one or more samples. The electronic device 847 may then determine an energy curve peak (e.g., maximum) for each set of contiguous samples greater than the threshold curve.

The electronic device 847 may determine 1510 at least one energy curve peak position by disqualifying any of the energy curve peaks based on a threshold number of samples. For example, the number of samples for each contiguous set of samples above the threshold curve may be denoted $C_{set}$, where set is a set number. The electronic device 847 may determine whether $C_{set} \geq C_{threshold}$ for each set number, where $C_{threshold}$ is a threshold number of samples. The electronic device 847 may disqualify any of the energy curve peaks corresponding to a $C_{set}$, where $C_{set} < C_{threshold}$. At least one energy curve peak position (e.g., energy curve peak samples) corresponding to a $C_{set}$, where $C_{set} \geq C_{threshold}$, may be determined 1510 as the at least one energy curve peak position.

The electronic device 847 may determine 1512 pitch pulse period signal boundaries 867 based on the at least one energy curve peak position. For example, the electronic device 847 may designate one or more midpoints between pairs of energy curve peak positions (if any) and/or frame boundaries as pitch pulse period signal boundaries 867. FIG. 14 shows examples of an excitation signal (e.g., signal 1485), an energy curve (e.g., the first averaged curve 1489*a*), a threshold curve (e.g., the second averaged curve 1489*b*), a disqualified peak 1499, energy curve peak positions (e.g., first averaged curve peak positions 1493) and pitch pulse period signal boundaries 1467 that may be obtained by performance of the method 1500.

Each of the procedures of the method 1500 may be performed for a previous frame (e.g., frame n−1) and for a current frame (e.g., frame n). For example, the electronic device 847 may determine 1502 first window sizes for frame n−1 and frame n. Furthermore, Equation (1) may be applied to frame n−1 to determine 1504 a previous frame energy curve and may be applied to frame n to determine 1504 a current frame energy curve. Also, Equation (2) may be applied to frame n−1 to determine 1506 a previous frame threshold curve and may be applied to frame n to determine 1506 a current frame threshold curve. Additionally, the electronic device 847 may determine 1508 energy curve peaks, determine 1510 at least one energy curve peak position and determine 1512 pitch pulse period signal boundaries for frame n−1 and frame n.

Figure 16:
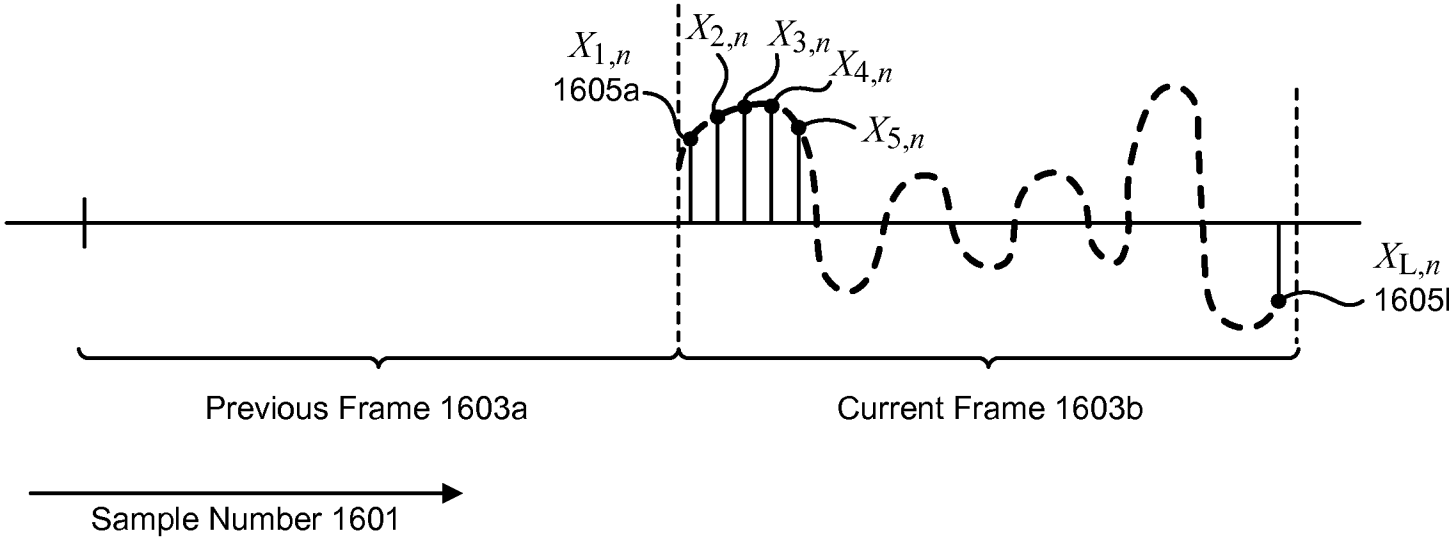
FIG. 16 is a graph illustrating an example of samples.

FIG. 16 is a graph illustrating an example of samples 1605. FIG. 16 illustrates a previous frame 1603*a* (e.g., frame n−1) and a current frame 1603*b* (e.g., frame n) according to sample number 1601. The current frame 1603*b* of length L includes samples 1605*a*−1 of a signal (e.g., excitation signal 877 or temporary synthesized speech signal 879). Signal samples 1605 may be denoted $X_{j,n}$ where $X_{L,n}$ 16051 is the last sample of the signal in frame n. In some configurations, a sliding window may be applied to the signal samples 1605 to determine an energy curve. For example, an energy curve for the current frame 1603*b* may be determined in accordance with Equation (1).

Figure 17:
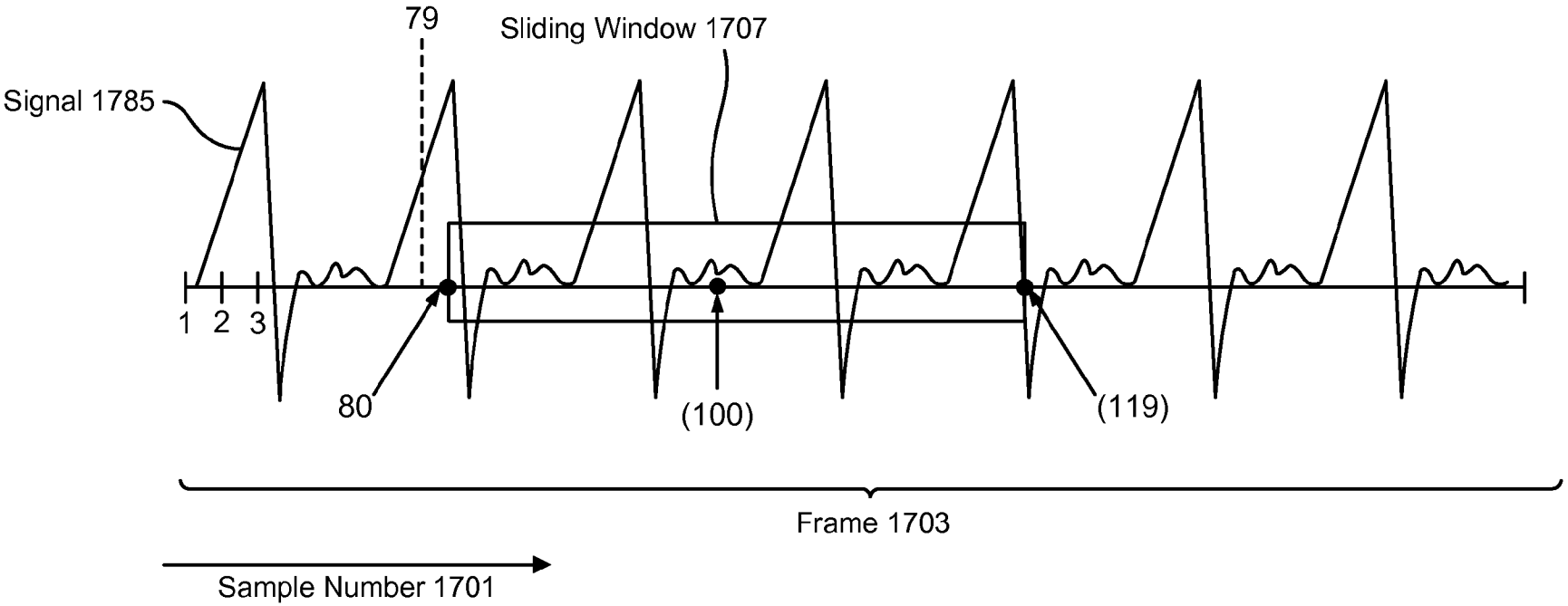
FIG. 17 is a graph illustrating an example of a sliding window for determining an energy curve.

FIG. 17 is a graph illustrating an example of a sliding window 1707 for determining an energy curve. In particular, FIG. 17 illustrates a frame 1703 (e.g., frame n) according to sample number 1701. The frame 1703 has a length L=320. The sliding window 1707 utilized in this example has a window size N=40. The energy curve may be determined (e.g., computed) as follows. FIG. 17 illustrates the sliding window 1707 centered at sample number i=100 from the frame start. Equation (1) described above may be applied to compute the energy (e.g., $e_{i,n}$) of a signal 1785 (e.g., X) corresponding to the center of the sliding window 1707 (e.g., i=100). Accordingly, $e_{100,n}=X_{80,n}^2+X_{81,n}^2+\ldots+X_{100,n}^2+\ldots+X_{119,n}^2$. Similarly, $e_{i,n}$ may be computed for all i from 1 to 320 to produce an energy curve.

Figure 18:
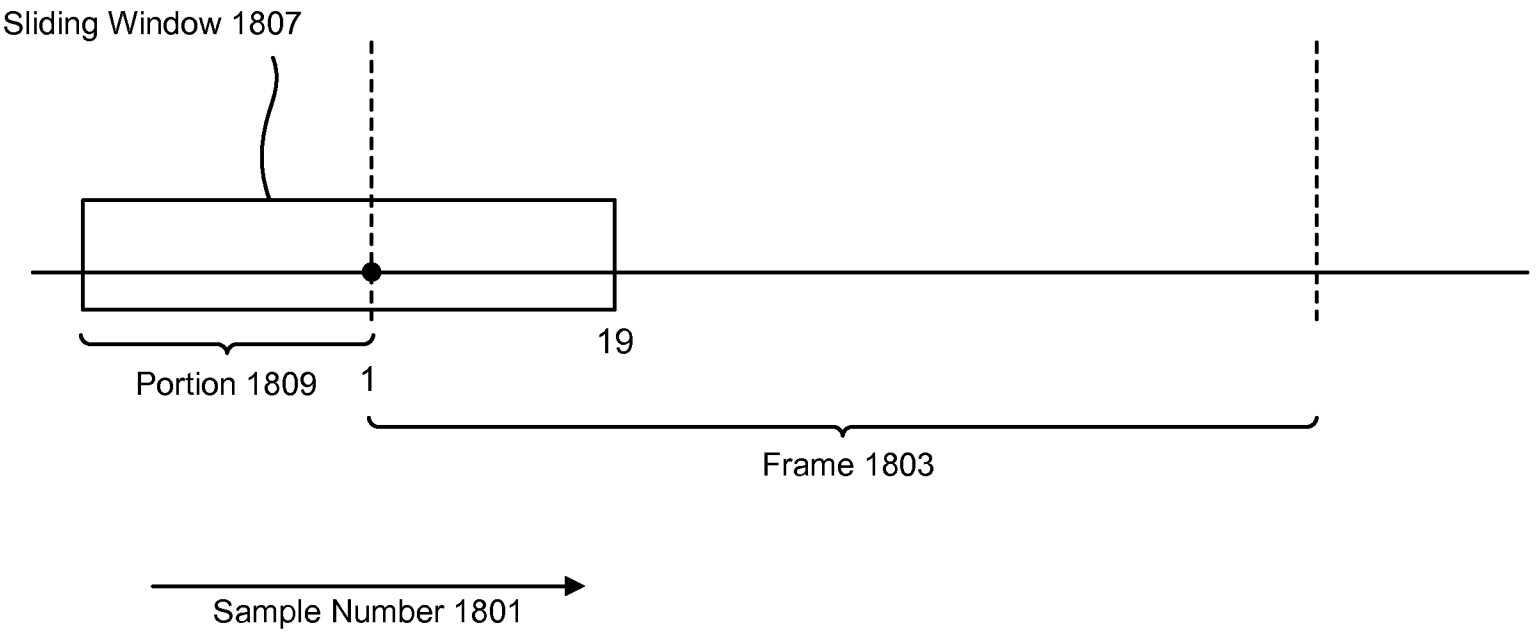
FIG. 18 illustrates another example of a sliding window.

FIG. 18 illustrates another example of a sliding window 1807. A frame 1803 (e.g., frame n) is illustrated according to sample number 1801. In this instance, a portion 1809 of the window 1807 is extended outside of the frame 1803. In some configurations, only samples within the frame 1803 may be added. For example, $e_{1,n}=X_{1,n}^2+X_{2,n}^2+\ldots+X_{19,n}^2$. This is why Equation (1) is written as $$e_{i,n} = \sum_{j=i-\frac{N}{2}}^{i+\frac{N}{2}-1} X_{j,n}^2,$$

where $X_{j,n}=0$ for $j \leq 0$ or $j>L$. Accordingly, for the first sample, $$e_{1,n} = \sum_{j=-20}^{19} X_{j,n}^2 = X_{-20,n}^2 + X_{-19,n}^2 + \ldots X_{-1,n}^2 + X_{0,n}^2 + X_{1,n}^2 + \ldots + X_{19,n}^2,$$

where all of the terms for $-20 \leq j \leq 0$ are equal to 0.

Figure 19:
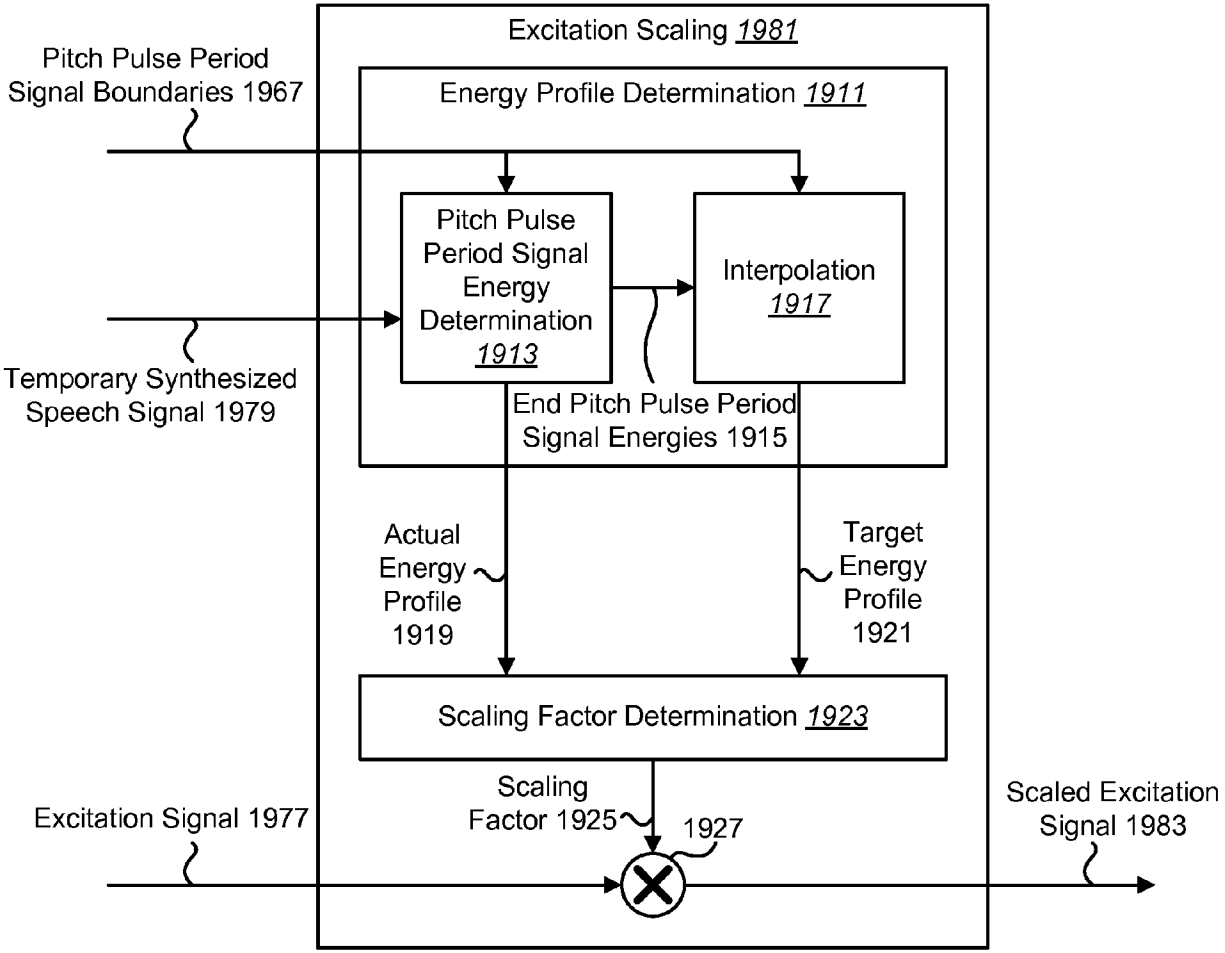
FIG. 19 is a block diagram illustrating one configuration of an excitation scaling module.

FIG. 19 is a block diagram illustrating one configuration of an excitation scaling module 1981. The excitation scaling module 1981 described in connection with FIG. 19 may be one example of the excitation scaling module 881 described in connection with FIG. 8. The excitation scaling module 1981 includes an energy profile determination module 1911, a scaling factor determination module 1923 and a multiplier 1927. The excitation scaling module 1981 and/or one or more components thereof may be implemented in hardware (e.g., circuitry), software or a combination of both.

The energy profile determination module 1911 determines an actual energy profile 1919 and a target energy profile 1921 based on the temporary synthesized speech signal 1979 and the pitch pulse period signal boundaries 1967. The energy profile determination module 1911 includes a pitch pulse period signal energy determination module 1913 and an interpolation module 1917.

The pitch pulse period signal energy determination module 1913 determines pitch pulse period signal energies of the temporary synthesized speech signal 1979 from the previous frame end pitch pulse period signal to the current frame end pitch pulse period signal as defined by the pitch pulse period signal boundaries 1967. For example, the pitch pulse period signal energy determination module 1913 may determine $E_p \forall p=\{p_{n-1}^e, \ldots, p_n^e\}$ in accordance with Equation (3). The pitch pulse period signal energies from the previous frame end pitch pulse period signal to the current frame end pitch pulse period signal may constitute the actual energy profile 1919 as described above (e.g., $E_{actual,p}=E_p$, where $p_{n-1}^e \leq p \leq p_n^e$).

The pitch pulse period signal energy determination module 1913 may provide end pitch pulse period signal energies 1915 of the temporary synthesized speech signal 1979 to the interpolation module 1917. For example, the end pitch pulse period signal energies 1915 may include the previous frame end pitch pulse period signal energy $E_{n-1}^e$ and the current frame end pitch pulse period signal energy $E_n^e$. For example, the end pitch pulse period signal energies 1915 may be the first and last pitch pulse period signal energies from the actual energy profile 1919.

The interpolation module 1917 may determine the target energy profile 1921 by interpolating (e.g., linearly or non-linearly interpolating) the end pitch pulse period signal energies 1915 over a number of pitch pulse period signals as defined by the pitch pulse period signal boundaries 1967. For example, the interpolation module 1917 may interpolate pitch pulse period signal energies for any pitch pulse period signals between the end pitch pulse period signal energies 1915 as described above in connection with FIG. 8. The end pitch pulse period signal energies 1915 and the interpolated pitch pulse period signal energies may constitute the target energy profile 1921 as described above (e.g., $E_{target,p}$, where $p_{n-1}^{e} \leq p \leq p_n^{e}$). The actual energy profile 1919 and the target energy profile 1921 may be provided to the scaling factor determination module 1923.

The scaling factor determination module 1923 may determine a scaling factor based on the actual energy profile 1919 and the target energy profile 1921. For example, the scaling factor determination module 1923 may determine $g_p$ in accordance with Equation (4) as described above. The scaling factor 1925 may include scaling values corresponding to the pitch pulse period signals that scale the actual energy profile to approximately match the target energy profile. The scaling factor 1925 may be provided to the multiplier 1927.

The multiplier 1927 scales the excitation signal 1977 to produce a scaled excitation signal 1983. For example, the multiplier 1927 may multiply sets of samples corresponding to pitch pulse period signals in the current frame by respective scaling values included in the scaling factor 1925. For instance, the multiplier 1927 may multiply a set of samples of the excitation signal 1977 that correspond to the first pitch pulse period signal in the current frame by a scaling value that also corresponds to the first pitch pulse period signal in the current frame. Additional sets of samples of the excitation signal 1977 may also be multiplied by corresponding scaling values.

Figure 20:
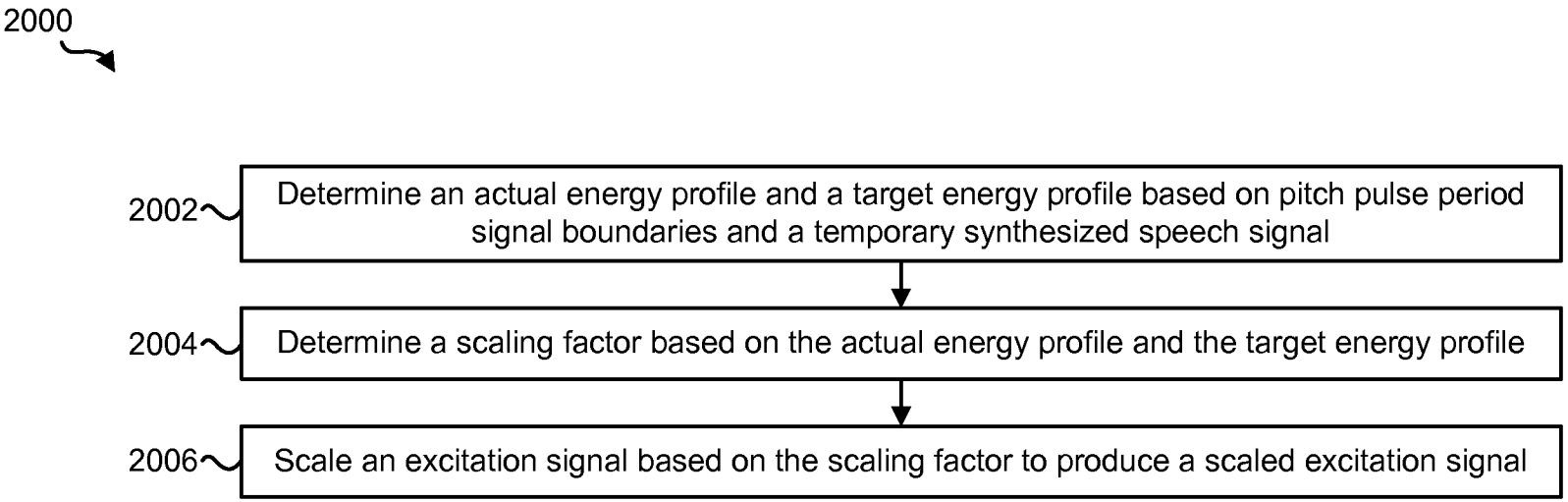
FIG. 20 is a flow diagram illustrating one configuration of a method for scaling a signal based on pitch pulse period signal boundaries.

FIG. 20 is a flow diagram illustrating one configuration of a method 2000 for scaling a signal based on pitch pulse period signal boundaries 867. An electronic device 847 may determine 2002 an actual energy profile and a target energy profile based on pitch pulse period signal boundaries 867 and a temporary synthesized speech signal 879.

The electronic device 847 may determine 2002 the actual energy profile by determining pitch pulse period signal energies from the previous frame end pitch pulse period signal to the current frame end pitch pulse period signal. For example, each pitch pulse period signal from the previous frame end pitch pulse period signal to the current frame end pitch pulse period signal may be defined by the pitch pulse period signal boundaries 867. The electronic device 847 may determine pitch pulse period signal energies based on sets of samples of the temporary synthesized speech signal 879 within each pair of pitch pulse period signal boundaries 867. For example, the electronic device 847 may determine the pitch pulse period signal energies in accordance with Equation (3). The actual energy profile may include the pitch pulse period signal energies of the temporary synthesized speech signal 879 for each pitch pulse period signal from a previous frame end pitch pulse period signal to the current frame end pitch pulse period signal (e.g., $E_{actual,p}=E_p$, where $p_{n-1}^{e} \leq p \leq p_n^{e}$) as described above.

The electronic device 847 may determine 2002 a target energy profile by interpolating (e.g., linearly or non-linearly interpolating) the previous frame end pitch pulse period signal energy and the current frame end pitch pulse period signal energy of the temporary synthesized speech signal 879. The temporary synthesized speech signal 879 may be utilized to determine the previous frame end pitch pulse period signal energy (e.g., $E_{n-1}^{e}$) and the current frame end pitch pulse period signal energy (e.g., $E_n^{e}$) as described above. The electronic device 847 may interpolate one or more pitch pulse period signal energies between the previous frame end pitch pulse period signal energy and the current frame end pitch pulse period signal energy based on a number of pitch pulse period signals defined by the pitch pulse period signal boundaries 867 as described above.

The electronic device 847 may determine 2004 a scaling factor based on the actual energy profile and the target energy profile. For example, the electronic device 847 may determine 2004 the scaling factor in accordance with Equation (4) as described above.

The electronic device 847 may scale 2006 an excitation signal 877 based on the scaling factor to produce a scaled excitation signal 883. For example, each pitch pulse period signal of the excitation signal 877 in the current frame may be multiplied by a corresponding scaling value as described above. Scaling an excitation signal 877 based on pitch pulse period signals (e.g., pitch pulse period signal-based smoothing) may be beneficial because it mitigates or suppresses potential artifacts while avoiding the creation of new artifacts in the synthesized speech signal.

Figure 21:
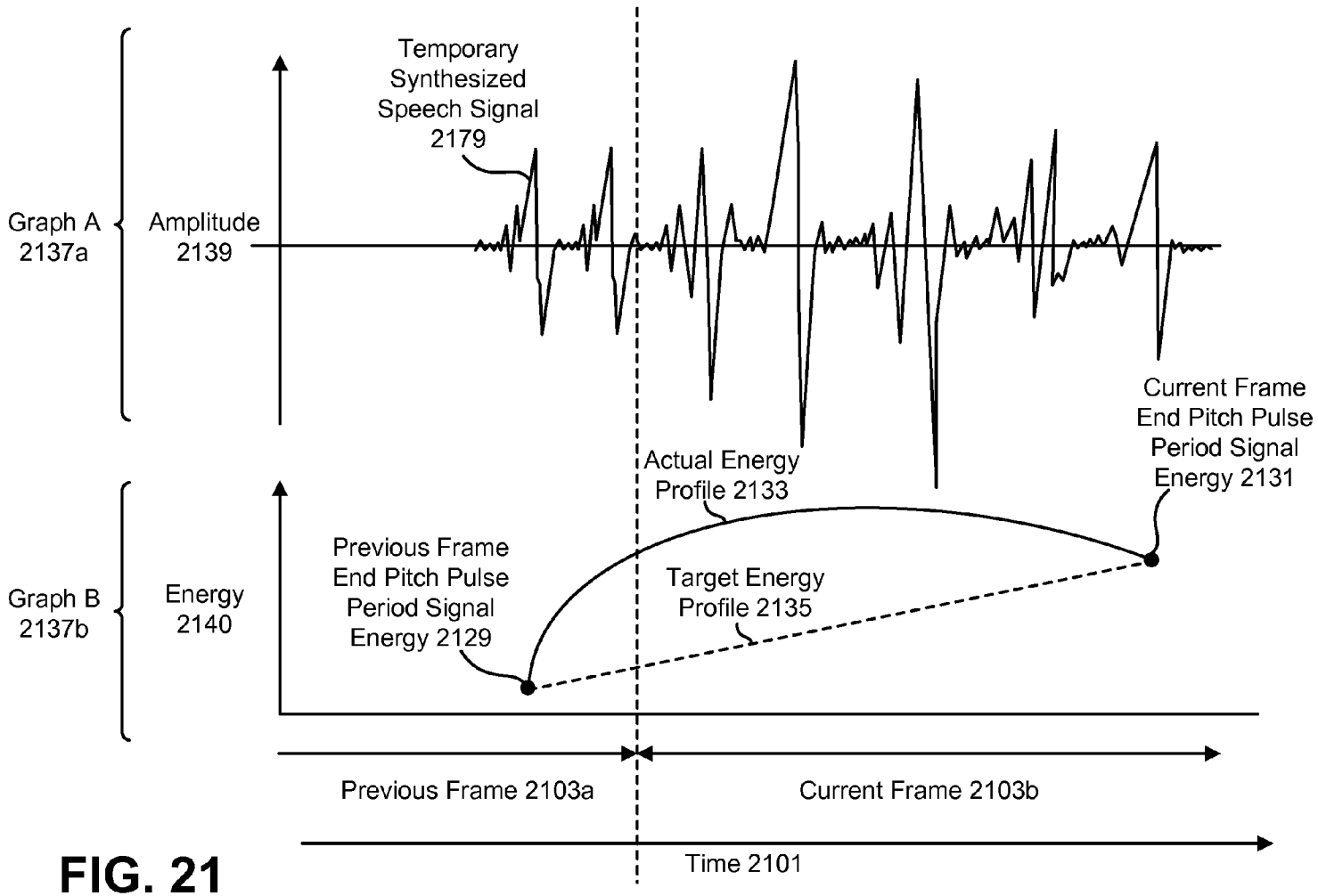
FIG. 21 includes graphs that illustrate examples of a temporary synthesized speech signal, an actual energy profile and a target energy profile.

FIG. 21 includes graphs 2137 that illustrate examples of a temporary synthesized speech signal 2179, an actual energy profile 2133 and a target energy profile 2135. The horizontal axes of graph A 2137*a* and graph B 2137*b* are illustrated in time 2101. The vertical axis of graph A 2137*a* is illustrated in amplitude 2139 and the vertical axis of graph B 2137*b* is illustrated in energy 2140. As described above, the amplitude 2139 may be represented as a number (e.g., floating point number, binary number with 16 bits, etc.) or an electromagnetic signal that corresponds to a voltage or current (for an electrical signal) in some configurations.

Graph A 2137*a* illustrates one example of a temporary synthesized speech signal 2179. As described above, the electronic device 847 may determine an actual energy profile 2133 of the temporary synthesized speech signal 2179. In particular, the actual energy profile 2133 may include pitch pulse period signal energies for each pitch pulse period signal from the previous frame end pitch pulse period signal energy 2129 to the current frame end pitch pulse period signal energy 2131. Graph B 2137*b* illustrates examples of a previous frame end pitch pulse period signal energy 2129 (e.g., $E_{n-1}^{e}$) and a current frame end pitch pulse period signal energy 2131 (e.g., $E_n^{e}$). The previous frame end pitch pulse period signal energy 2129 corresponds to the last pitch pulse period signal of the previous frame 2103*a*. The current frame end pitch pulse period signal energy 2131 corresponds to the last pitch pulse period signal of the current frame 2103*b*.

As described above, the electronic device 847 may determine a target energy profile 2135. The target energy profile 2135 may be interpolated between the previous frame end pitch pulse period signal energy 2129 and the current frame end pitch pulse period signal energy 2131. It should be noted that although FIG. 21 illustrates one example where the target energy profile 2135 increases over time, other scenarios are possible in which a target energy profile declines over time or remains at the same level (e.g., flat).

Figure 22:
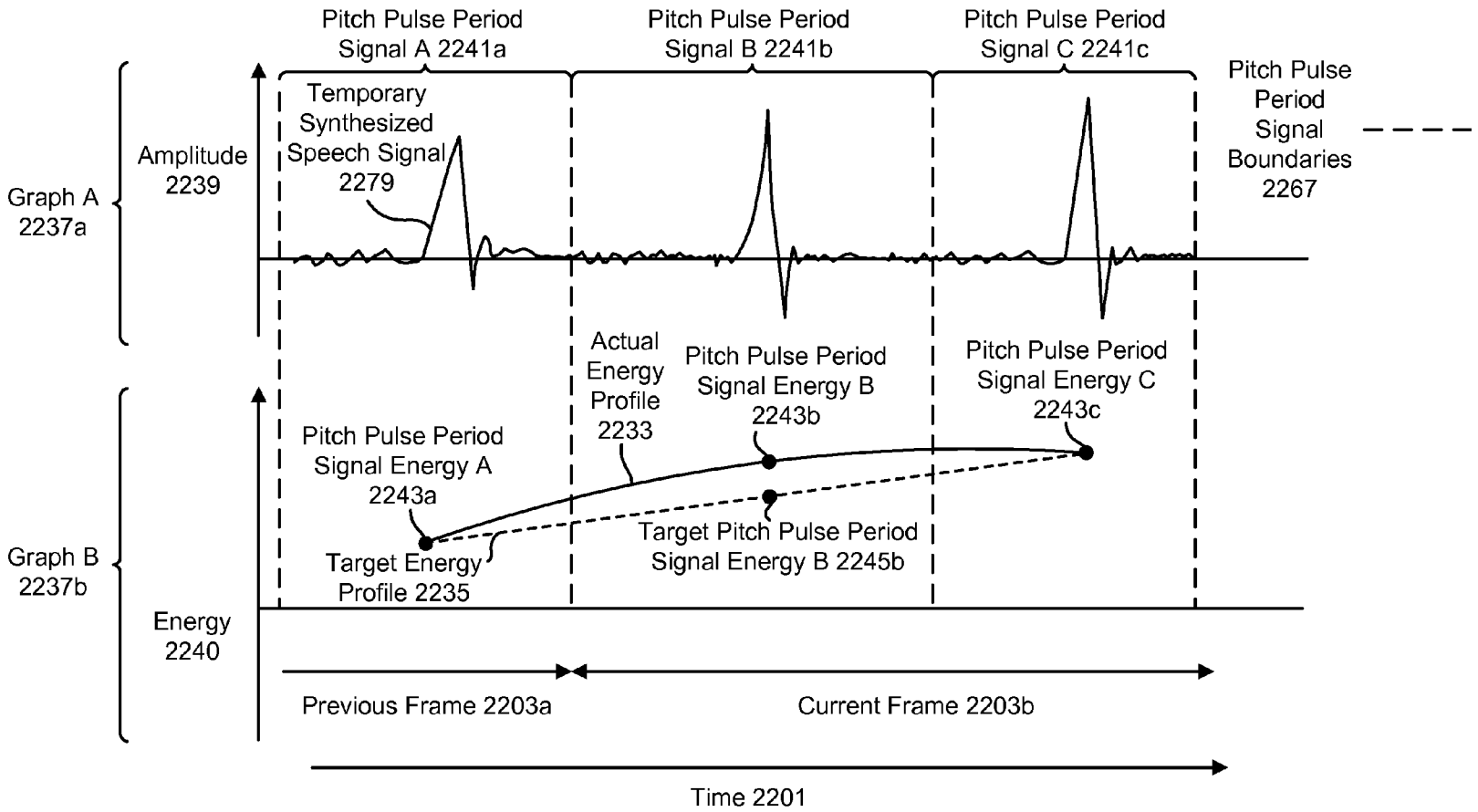
FIG. 22 includes graphs that illustrate examples of a temporary synthesized speech signal, an actual energy profile and a target energy profile.

FIG. 22 includes graphs 2237 that illustrate examples of a temporary synthesized speech signal 2279, an actual energy profile 2233 and a target energy profile 2235. The horizontal axes of graph A 2237*a* and graph B 2237*b* are illustrated in time 2201. The vertical axis of graph A 2237*a* is illustrated in amplitude 2239 and the vertical axis of graph B 2237*b* is illustrated in energy 2240. A previous frame 2203*a* and a current frame 2203*b* are illustrated.

Graph A 2237*a* illustrates one example of a temporary synthesized speech signal 2279. In this example, pitch pulse period signal A 2241*a* (e.g., the previous frame end pitch pulse period signal $p_{n-1}^{e}$), pitch pulse period signal B 2241*b* and pitch pulse period signal C 2241*c* (e.g., the current frame end pitch pulse period signal $p_{n}^{e}$) of the temporary synthesized speech signal 2279 are shown. The pitch pulse period signals 2241*a-c* are defined by pitch pulse period signal boundaries 2267.

Graph B 2237*b* illustrates one example of an actual energy profile 2233. The actual energy profile 2233 may include pitch pulse period signal energies 2243*a-c* for each pitch pulse period signal 2241*a-c*, including pitch pulse period signal energy A 2243*a* (e.g., the previous frame end pitch pulse period signal energy $E_{n-1}^{e}$), pitch pulse period signal energy B 2243*b* and pitch pulse period signal energy C 2243*c* (e.g., the current frame end pitch pulse period signal energy $E_{n}^{e}$).

Graph B 2237*b* also illustrates one example of a target energy profile 2235. The target energy profile 2235 may be interpolated between pitch pulse period signal energy A 2243*a* and pitch pulse period signal energy C 2243*c*. In particular, the electronic device 847 may interpolate target pitch pulse period signal energy B 2245*b* between pitch pulse period signal energy A 2243*a* and pitch pulse period signal energy C 2243*c*. Accordingly, the target energy profile 2235 includes pitch pulse period signal energy A 2243*a*, target pitch pulse period signal energy B 2245*b* and pitch pulse period signal energy C 2243*c*.

The electronic device 847 may determine a scaling factor that scales the actual energy profile 2233 to approximately match the target energy profile 2235. In this example, the scaling factor includes a scaling value to scale down pitch pulse period signal energy B 2243 to match target pitch pulse period signal energy B 2245. This scaling value may be applied to pitch pulse period signal B 2241*b* of the excitation signal 877. For instance, the actual energy profile 2233 is scaled to match the target energy profile 2235, resulting in a slight attenuation of pitch pulse period signal B 2241*b* of the excitation signal 877.

Figure 23:
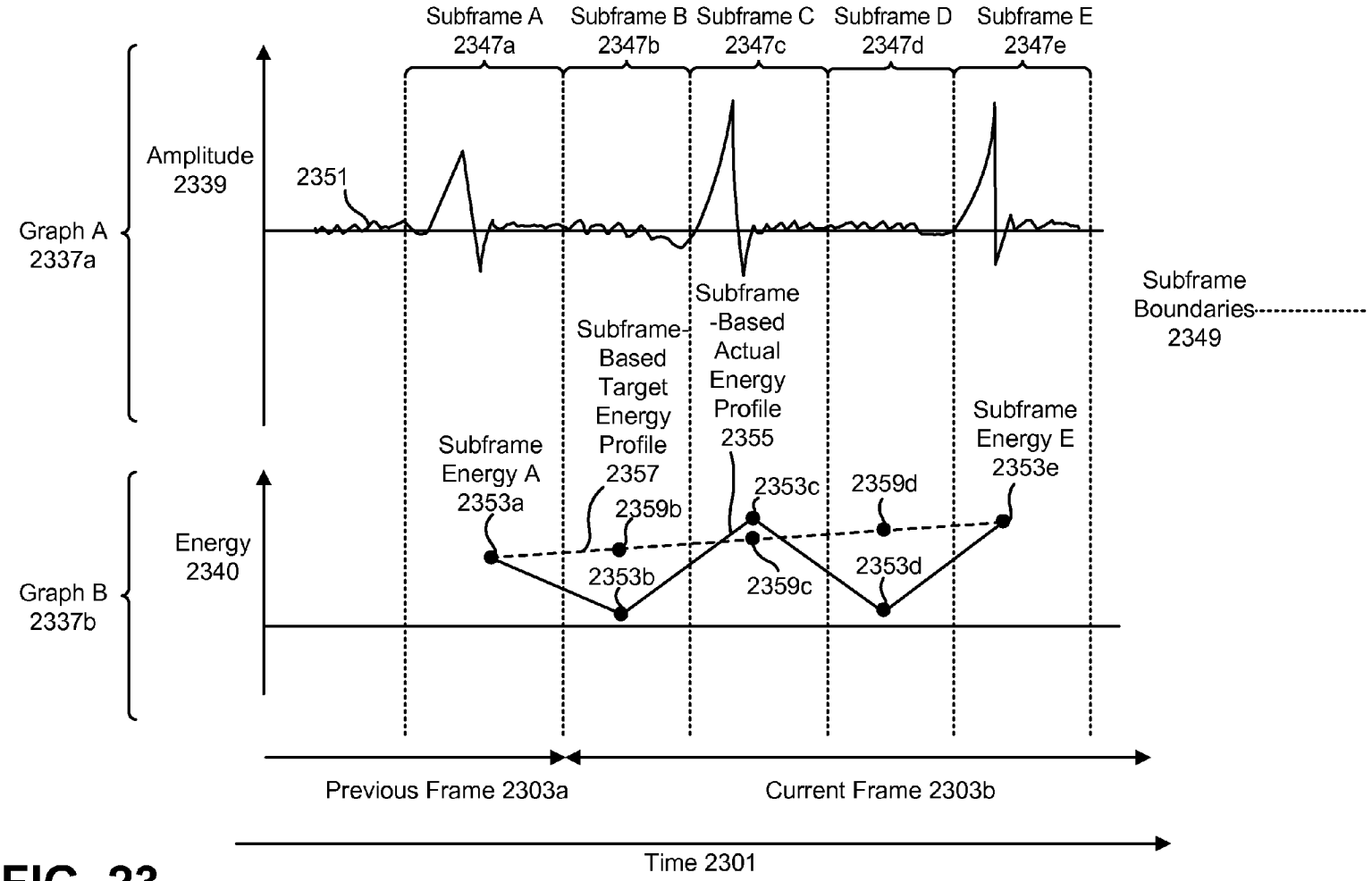
FIG. 23 includes graphs that illustrate examples of a speech signal, a subframe-based actual energy profile and a subframe-based target energy profile.

FIG. 23 includes graphs 2337 that illustrate examples of a speech signal 2351, a subframe-based actual energy profile 2355 and a subframe-based target energy profile 2357. The horizontal axes of graph A 2337*a* and graph B 2337*b* are illustrated in time 2301. The vertical axis of graph A 2337*a* is illustrated in amplitude 2339 and the vertical axis of graph B 2337*b* is illustrated in energy 2340. A previous frame 2303*a* and a current frame 2303*b* are illustrated.

Graph A 2337*a* illustrates one example of a speech signal 2351. In this example, subframes A-E 2347*a-e* and subframe boundaries 2349 of the speech signal 2351 are shown. Specifically, subframe A 2347*a* is the last subframe of the previous frame 2303*a* and subframes B-E 2347*b-e* are included in the current frame 2303*b*.

Graph B 2337*b* illustrates one example of a subframe-based actual energy profile 2355. The subframe-based actual energy profile 2355 may include subframe energies 2353*a-e* corresponding to each subframe 2347*a-e*.

Graph B 2337*b* also illustrates one example of a subframe-based target energy profile 2357. The subframe-based target energy profile 2357 may be interpolated between subframe energy A 2353*a* and subframe energy E 2353*e*. In particular, target subframe energy B 2359*b*, target subframe energy C 2359*c* and target subframe energy D 2359*d* may be interpolated between subframe energy A 2353*a* and subframe energy E 2353*e*. Accordingly, the subframe-based target energy profile 2357 includes subframe energy A 2353*a*, target subframe energies B-D 2359*b-d* and subframe energy E 2353*e*.

Subframe A 2347*a* (e.g., the last subframe of the previous frame 2303*a*) may include high energy, since it includes a pitch peak. Also, subframe C 2347*c* and subframe E 2347*e* of the current frame 2303*b* may include high energies since they include pitch peaks. However, subframe B 2347*b* and subframe D 2347*d* may include comparatively little energy, since they do not include pitch peaks. As illustrated in FIG. 23, subframe energy B 2353*b* and subframe energy D 2353*d* are non-zero, but very small. If it is attempted to scale the subframe-based actual energy profile 2355 to match the subframe-based target energy profile 2357, the scaling factor would scale up (e.g., amplify) a signal in subframe B 2347*b* and subframe D 2347*d*.

Figure 24:
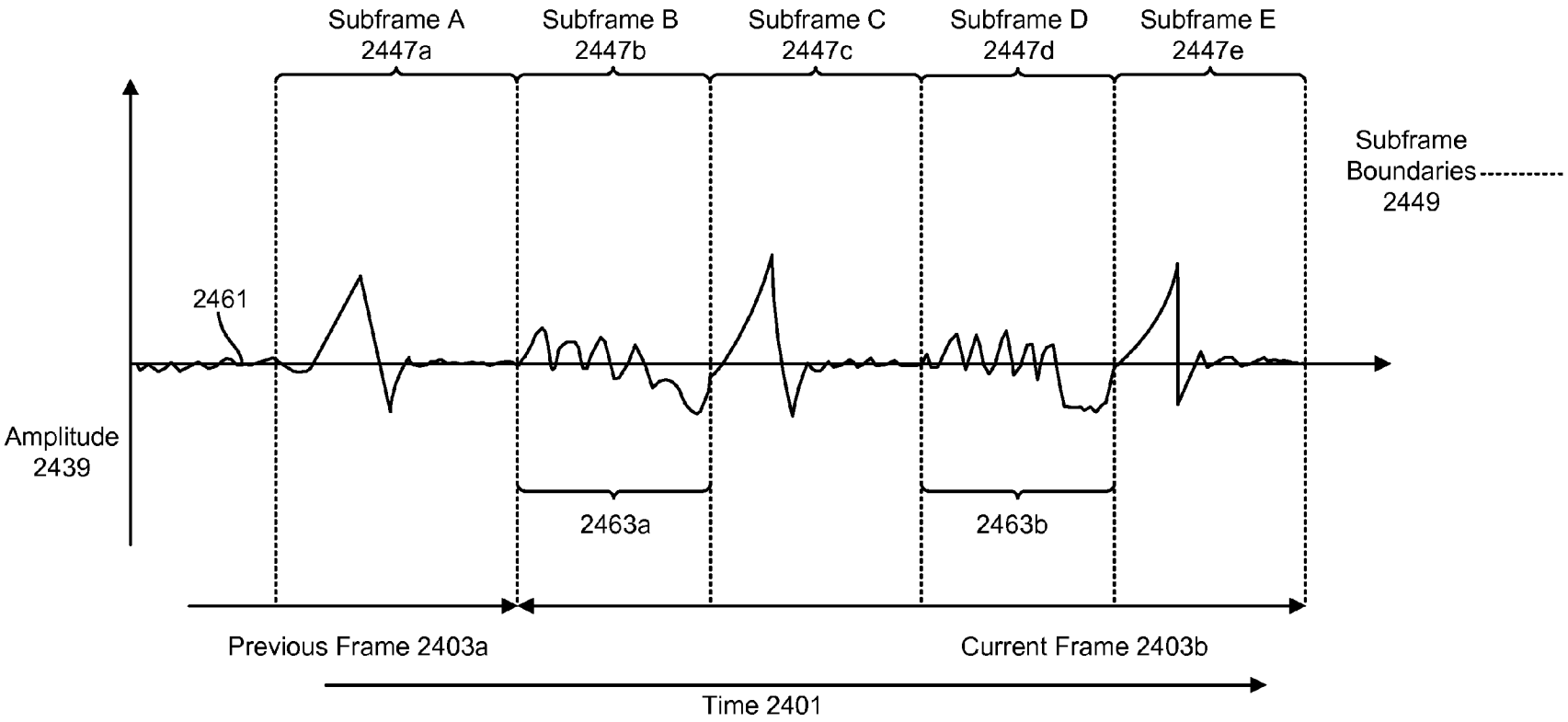
FIG. 24 includes a graph that illustrates one example of a speech signal after scaling.

FIG. 24 includes a graph that illustrates one example of a speech signal after scaling 2461. The horizontal axis of the graph is illustrated in time 2401. The vertical axis of the graph is illustrated in amplitude 2439. A previous frame 2403*a* and a current frame 2403*b* are illustrated.

In this example, subframes A-E 2447*a-e* and subframe boundaries 2449 of the speech signal after scaling 2461 are shown. Specifically, subframe A 2447*a* is the last subframe of the previous frame 2403*a* and subframes B-E 2447*b-e* are included in the current frame 2403*b*.

FIG. 24 continues the example described in connection with FIG. 23. Accordingly, subframes A-E 2447*a-e* in FIG. 24 correspond to subframes A-E 2347*a-e*. Because subframe B 2347*b* and subframe D 2347*d* included relatively little energy, a scaling factor would scale up a signal in those subframes in order for the subframe-based actual energy profile 2355 to match the subframe-based target energy profile 2357 as described in connection with FIG. 23. Accordingly, a scaling factor amplifies subframe B 2447*b* and subframe D 2447*d*, which results in speech artifacts 2463*a-b* in the speech signal after scaling 2461 in subframe B 2447*b* and subframe D 2447*d*. The speech artifacts 2463*a-b* may result in degraded (e.g., annoying) speech quality. This illustrates one benefit of pitch pulse period signal-based scaling compared to subframe-based scaling. In particular, pitch-pulse based scaling may mitigate potential speech artifacts resulting from an erased frame while avoiding the creation of new speech artifacts. In comparison, subframe-based scaling may create new speech artifacts, as described in connection with FIG. 23 and FIG. 24.

Figure 25:
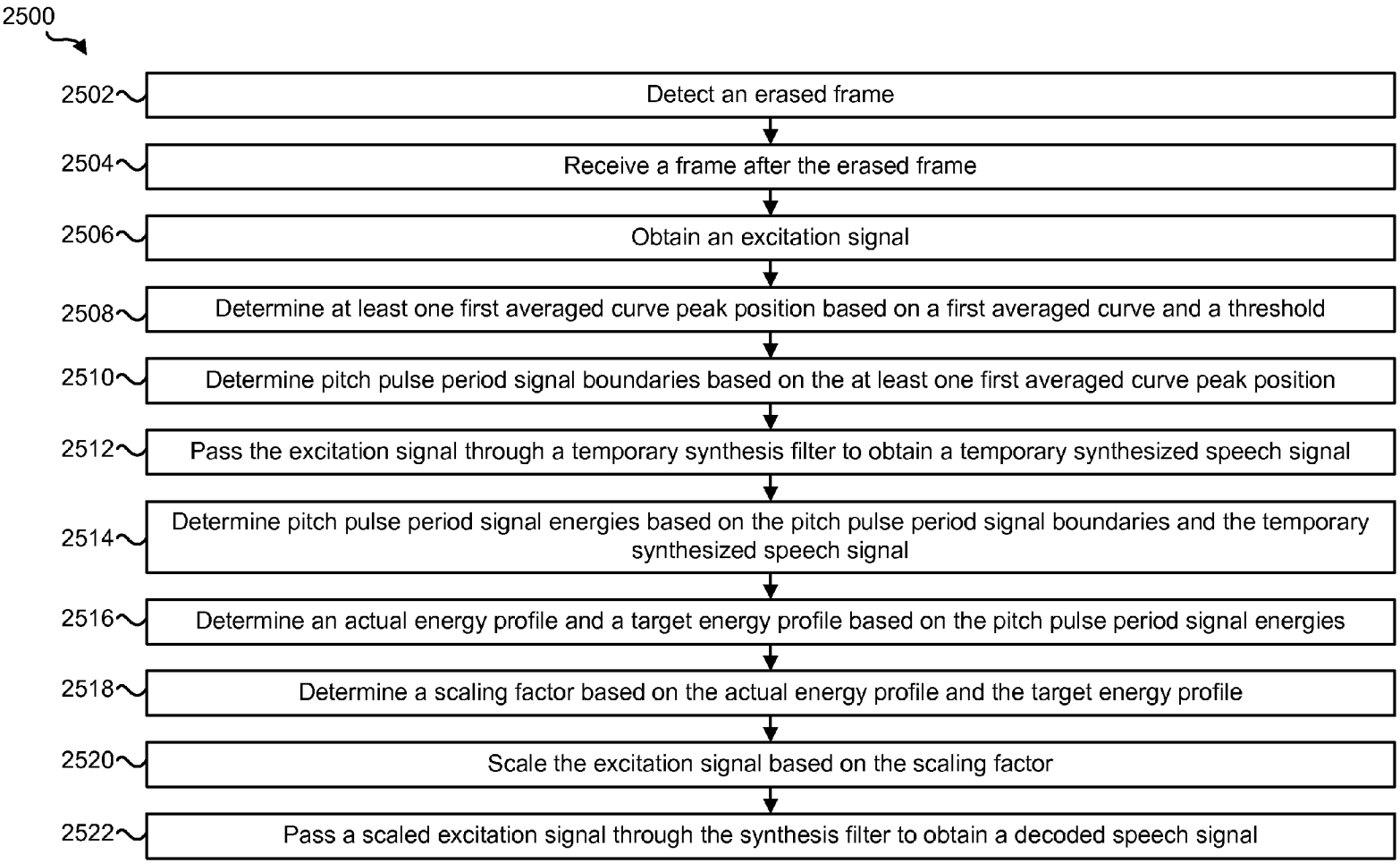
FIG. 25 is a flow diagram illustrating a more specific configuration of a method for scaling a signal based on pitch pulse period signal boundaries.

FIG. 25 is a flow diagram illustrating a more specific configuration of a method 2500 for scaling a signal based on pitch pulse period signal boundaries 867. For example, one or more of the procedures described in connection with FIG. 25 may be performed in an approach for pitch pulse period signal-based energy smoothing. One or more of the procedures described in connection with FIG. 25 may be accomplished as described above.

An electronic device 847 may detect 2502 an erased frame. The electronic device 847 may receive 2504 a frame after the erased frame. For example, a previous frame (e.g., frame n−1) may be an erased frame and a current frame (e.g., frame n) may be received correctly. In some configurations, the electronic device 847 may attempt to conceal the erased frame by generating one or more parameters (e.g., an excitation signal, synthesis filter parameters, etc.) to replace the erased frame. The resulting concealed frame may be based on an earlier frame. Some configurations of the systems and methods disclosed herein may be utilized to handle variations (e.g., energy variations) between a concealed frame and a correctly received frame.

The electronic device 847 may obtain 2506 an excitation signal 877. For example, the electronic device 847 may receive and/or dequantize one or more parameters (e.g., adaptive codebook index, adaptive codebook gain, fixed codebook index, fixed codebook gain, etc.) that indicate an excitation signal 877.

The electronic device 847 may determine 2508 at least one first averaged curve peak position based on a first averaged curve and a threshold. The electronic device 847 may also determine 2510 pitch pulse period signal boundaries 867 based on the at least one first averaged curve peak position.

The electronic device 847 may pass 2512 the excitation signal 877 through a temporary synthesis filter 869 to obtain a temporary synthesized speech signal 879. For example, the electronic device 847 may utilize a temporary memory array or update to pass 2512 the excitation signal 877 through the temporary synthesis filter 869.

The electronic device 847 may determine 2514 pitch pulse period signal energies based on the pitch pulse period signal boundaries 867 and the temporary synthesized speech signal 879. The electronic device 847 may determine 2516 an actual energy profile and a target energy profile based on the pitch pulse period signal energies.

The electronic device 847 may determine 2518 a scaling factor based on the actual energy profile and the target energy profile. The electronic device 847 may scale 2520 the excitation signal 877 based on the scaling factor. This may produce a scaled excitation signal 883. The electronic device 847 may pass 2522 the scaled excitation signal 883 through the synthesis filter 861 to obtain a decoded speech signal (e.g., a synthesized speech signal). In this case, the synthesis filter 861 memory may be updated (whereas the synthesis filter 861 memory may not be updated when generating the temporary synthesized speech signal 879). This method 2500 may help to ensure that the decoded speech signal 863 has no artifacts or reduced artifacts.

Figure 26:
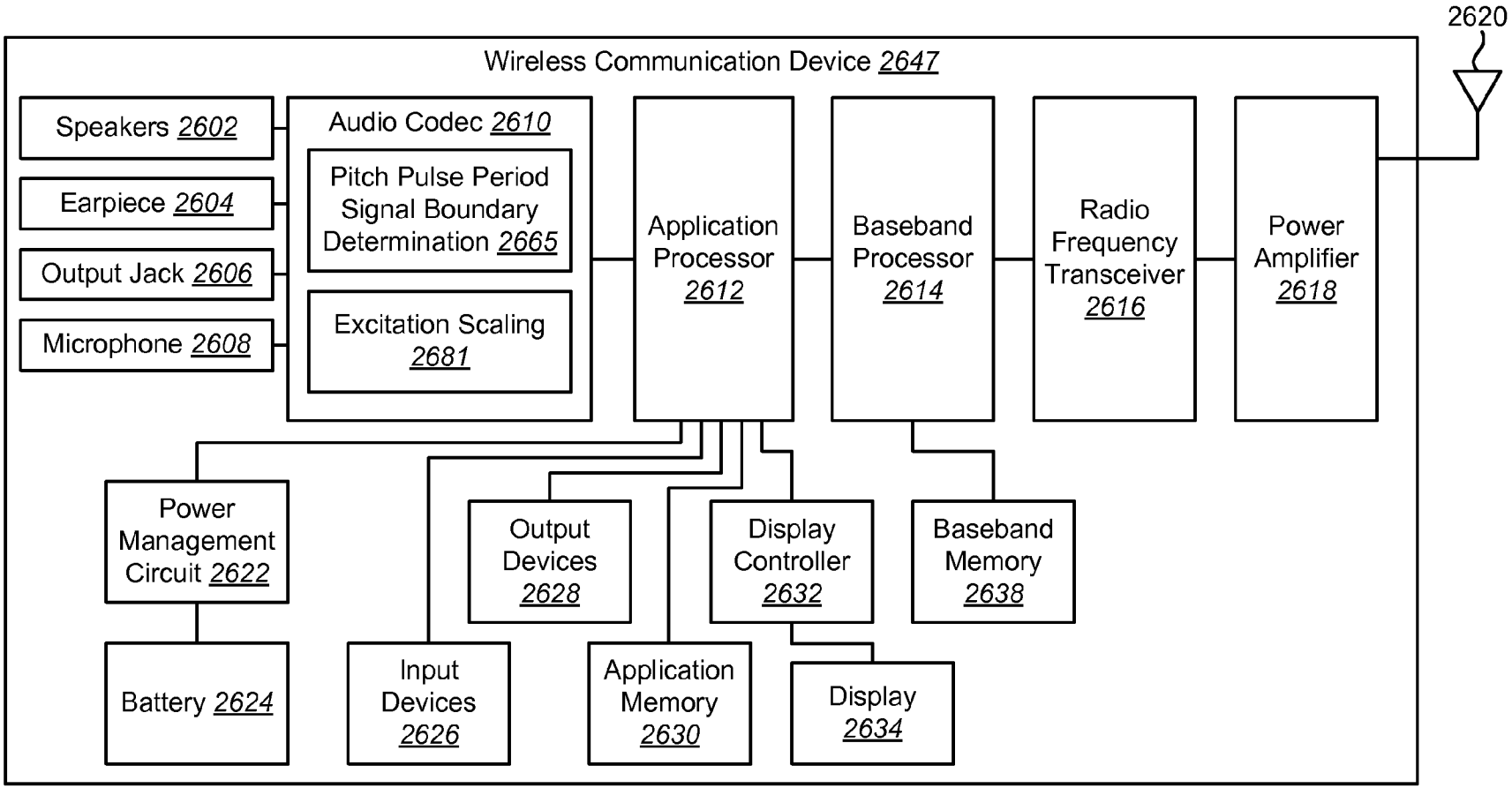
FIG. 26 is a block diagram illustrating one configuration of a wireless communication device in which systems and methods for determining pitch pulse period signal boundaries may be implemented.

FIG. 26 is a block diagram illustrating one configuration of a wireless communication device 2647 in which systems and methods for determining pitch pulse period signal boundaries may be implemented. The wireless communication device 2647 illustrated in FIG. 26 may be an example of at least one of the electronic devices described herein. The wireless communication device 2647 may include an application processor 2612. The application processor 2612 generally processes instructions (e.g., runs programs) to perform functions on the wireless communication device 2647. The application processor 2612 may be coupled to an audio coder/decoder (codec) 2610.

The audio codec 2610 may be used for coding and/or decoding audio signals. The audio codec 2610 may be coupled to at least one speaker 2602, an earpiece 2604, an output jack 2606 and/or at least one microphone 2608. The speakers 2602 may include one or more electro-acoustic transducers that convert electrical or electronic signals into acoustic signals. For example, the speakers 2602 may be used to play music or output a speakerphone conversation, etc. The earpiece 2604 may be another speaker or electro-acoustic transducer that can be used to output acoustic signals (e.g., speech signals) to a user. For example, the earpiece 2604 may be used such that only a user may reliably hear the acoustic signal. The output jack 2606 may be used for coupling other devices to the wireless communication device 2647 for outputting audio, such as headphones. The speakers 2602, earpiece 2604 and/or output jack 2606 may generally be used for outputting an audio signal from the audio codec 2610. The at least one microphone 2608 may be an acousto-electric transducer that converts an acoustic signal (such as a user's voice) into electrical or electronic signals that are provided to the audio codec 2610.

The audio codec 2610 (e.g., a decoder) may include a pitch pulse period signal boundary determination module 2665 and/or an excitation scaling module 2681. The pitch pulse period signal boundary determination module 2665 may determine pitch pulse period signal boundaries as described above. The excitation scaling module 2681 may scale an excitation signal as described above.

The application processor 2612 may also be coupled to a power management circuit 2622. One example of a power management circuit 2622 is a power management integrated circuit (PMIC), which may be used to manage the electrical power consumption of the wireless communication device 2647. The power management circuit 2622 may be coupled to a battery 2624. The battery 2624 may generally provide electrical power to the wireless communication device 2647. For example, the battery 2624 and/or the power management circuit 2622 may be coupled to at least one of the elements included in the wireless communication device 2647.

The application processor 2612 may be coupled to at least one input device 2626 for receiving input. Examples of input devices 2626 include infrared sensors, image sensors, accelerometers, touch sensors, keypads, etc. The input devices 2626 may allow user interaction with the wireless communication device 2647. The application processor 2612 may also be coupled to one or more output devices 2628. Examples of output devices 2628 include printers, projectors, screens, haptic devices, etc. The output devices 2628 may allow the wireless communication device 2647 to produce output that may be experienced by a user.

The application processor 2612 may be coupled to application memory 2630. The application memory 2630 may be any electronic device that is capable of storing electronic information. Examples of application memory 2630 include double data rate synchronous dynamic random access memory (DDRAM), synchronous dynamic random access memory (SDRAM), flash memory, etc. The application memory 2630 may provide storage for the application processor 2612. For instance, the application memory 2630 may store data and/or instructions for the functioning of programs that are run on the application processor 2612.

The application processor 2612 may be coupled to a display controller 2632, which in turn may be coupled to a display 2634. The display controller 2632 may be a hardware block that is used to generate images on the display 2634. For example, the display controller 2632 may translate instructions and/or data from the application processor 2612 into images that can be presented on the display 2634. Examples of the display 2634 include liquid crystal display (LCD) panels, light emitting diode (LED) panels, cathode ray tube (CRT) displays, plasma displays, etc.

The application processor 2612 may be coupled to a baseband processor 2614. The baseband processor 2614 generally processes communication signals. For example, the baseband processor 2614 may demodulate and/or decode received signals. Additionally or alternatively, the baseband processor 2614 may encode and/or modulate signals in preparation for transmission.

The baseband processor 2614 may be coupled to baseband memory 2638. The baseband memory 2638 may be any electronic device capable of storing electronic information, such as SDRAM, DDRAM, flash memory, etc. The baseband processor 2614 may read information (e.g., instructions and/or data) from and/or write information to the baseband memory 2638. Additionally or alternatively, the baseband processor 2614 may use instructions and/or data stored in the baseband memory 2638 to perform communication operations.

The baseband processor 2614 may be coupled to a radio frequency (RF) transceiver 2616. The RF transceiver 2616 may be coupled to a power amplifier 2618 and one or more antennas 2620. The RF transceiver 2616 may transmit and/or receive radio frequency signals. For example, the RF transceiver 2616 may transmit an RF signal using a power amplifier 2618 and at least one antenna 2620. The RF transceiver 2616 may also receive RF signals using the one or more antennas 2620.

Figure 27:
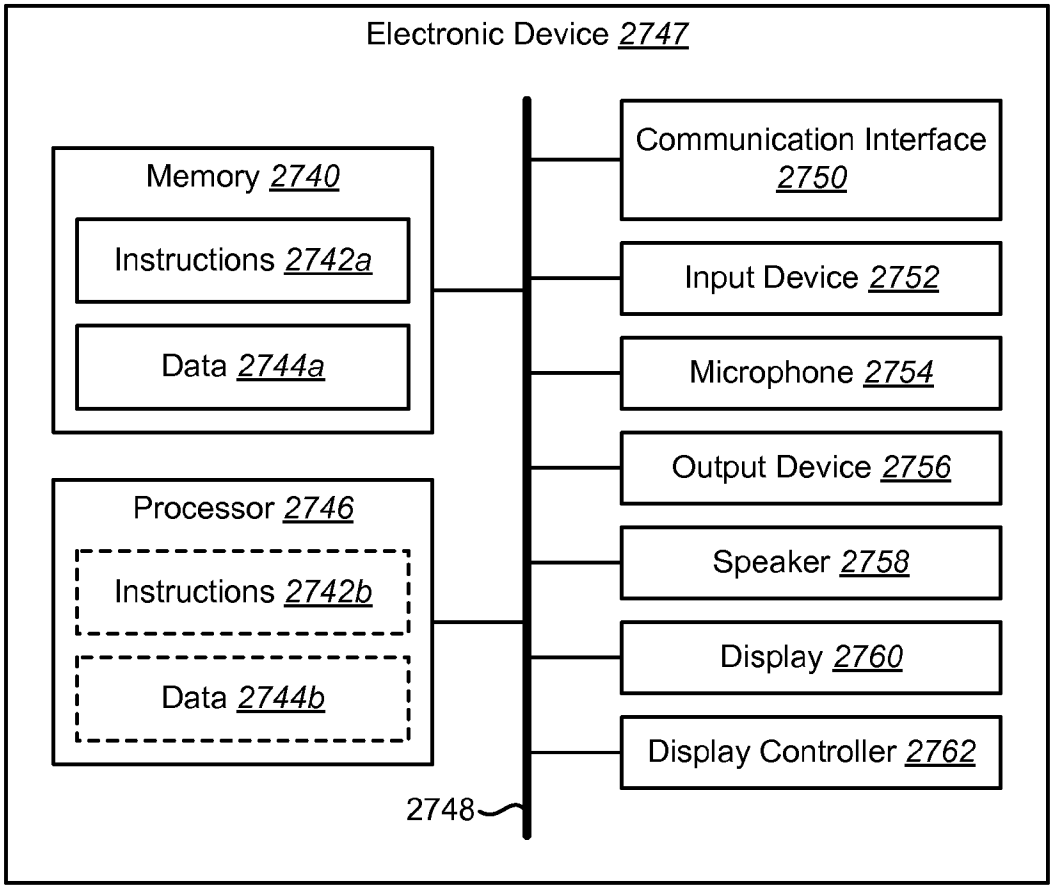
FIG. 27 illustrates various components that may be utilized in an electronic device.

FIG. 27 illustrates various components that may be utilized in an electronic device 2747. The illustrated components may be located within the same physical structure or in separate housings or structures. The electronic device 2747 described in connection with FIG. 27 may be implemented in accordance with one or more of the devices described herein. The electronic device 2747 includes a processor 2746. The processor 2746 may be a general purpose single- or multi-chip microprocessor (e.g., an ARM), a special purpose microprocessor (e.g., a digital signal processor (DSP)), a microcontroller, a programmable gate array, etc. The processor 2746 may be referred to as a central processing unit (CPU). Although just a single processor 2746 is shown in the electronic device 2747 of FIG. 27, in an alternative configuration, a combination of processors (e.g., an ARM and DSP) could be used.

The electronic device 2747 also includes memory 2740 in electronic communication with the processor 2746. That is, the processor 2746 can read information from and/or write information to the memory 2740. The memory 2740 may be any electronic component capable of storing electronic information. The memory 2740 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 2744*a* and instructions 2742*a* may be stored in the memory 2740. The instructions 2742*a* may include one or more programs, routines, sub-routines, functions, procedures, etc. The instructions 2742*a* may include a single computer-readable statement or many computer-readable statements. The instructions 2742*a* may be executable by the processor 2746 to implement one or more of the methods, functions and procedures described above. Executing the instructions 2742*a* may involve the use of the data 2744*a* that is stored in the memory 2740. FIG. 27 shows some instructions 2742*b* and data 2744*b* being loaded into the processor 2746 (which may come from instructions 2742*a* and data 2744*a*).

The electronic device 2747 may also include one or more communication interfaces 2750 for communicating with other electronic devices. The communication interfaces 2750 may be based on wired communication technology, wireless communication technology, or both. Examples of different types of communication interfaces 2750 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 2747 may also include one or more input devices 2752 and one or more output devices 2756. Examples of different kinds of input devices 2752 include a keyboard, mouse, microphone, remote control device, button, joystick, trackball, touchpad, lightpen, etc. For instance, the electronic device 2747 may include one or more microphones 2754 for capturing acoustic signals. In one configuration, a microphone 2754 may be a transducer that converts acoustic signals (e.g., voice, speech) into electrical or electronic signals. Examples of different kinds of output devices 2756 include a speaker, printer, etc. For instance, the electronic device 2747 may include one or more speakers 2758. In one configuration, a speaker 2758 may be a transducer that converts electrical or electronic signals into acoustic signals. One specific type of output device that may be typically included in an electronic device 2747 is a display device 2760. Display devices 2760 used with configurations disclosed herein may utilize any suitable image projection technology, such as a cathode ray tube (CRT), liquid crystal display (LCD), light-emitting diode (LED), gas plasma, electroluminescence, or the like. A display controller 2762 may also be provided for converting data stored in the memory 2740 into text, graphics, and/or moving images (as appropriate) shown on the display device 2760.

The various components of the electronic device 2747 may be coupled together by one or more buses, which may include a power bus, a control signal bus, a status signal bus, a data bus, etc. For simplicity, the various buses are illustrated in FIG. 27 as a bus system 2748. It should be noted that FIG. 27 illustrates only one possible configuration of an electronic device 2747. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for determining pitch pulse period signal boundaries by an electronic device, comprising:

obtaining a signal;

determining a first averaged curve based on the signal;

determining at least one first averaged curve peak position based on the first averaged curve and a threshold, wherein the threshold comprises a second averaged curve based on the first averaged curve;

determining pitch pulse period signal boundaries based on the at least one first averaged curve peak position; and synthesizing a speech signal.

2. The method of claim 1, wherein the first averaged curve is an energy curve.

3. The method of claim 1, further comprising determining the second averaged curve by determining a sliding window average of the first averaged signal.

4. The method of claim 1, wherein determining the at least one averaged curve peak position comprises disqualifying one or more peaks of the first averaged curve that have less than a threshold number of samples beyond the threshold.

5. The method of claim 1, wherein determining the pitch pulse period signal boundaries comprises designating a midpoint between a pair of first averaged curve peak positions as a pitch pulse period signal boundary.

6. The method of claim 1, wherein determining the first averaged curve comprises determining a sliding window average of the signal.

7. The method of claim 1, further comprising determining an actual energy profile and a target energy profile based on the pitch pulse period signal boundaries and a temporary synthesized speech signal.

8. The method of claim 7, wherein determining the target energy profile comprises interpolating a previous frame end pitch pulse period energy and a current frame end pitch pulse period energy of the temporary synthesized speech signal.

9. The method of claim 7, further comprising determining a scaling factor based on the actual energy profile and the target energy profile.

10. The method of claim 9, further comprising scaling an excitation signal based on the scaling factor to produce a scaled excitation signal.

11. The method of claim 1, wherein the signal is an excitation signal.

12. The method of claim 1, wherein the signal is a temporary synthesized speech signal.

13. An electronic device for determining pitch pulse period signal boundaries, comprising:

pitch pulse period signal boundary determination circuitry configured to determine a first averaged curve based on a signal, determine at least one first averaged curve peak position based on the first averaged curve and a threshold, wherein the threshold comprises a second averaged curve based on the first averaged curve, and determine pitch pulse period signal boundaries based on the at least one first averaged curve peak position; and synthesis filter circuitry configured to synthesize a speech signal.

14. The electronic device of claim 13, wherein the first averaged curve is an energy curve.

15. The electronic device of claim 13, wherein the pitch pulse period signal boundary determination circuitry is configured to determine the second averaged curve by determining a sliding window average of the first averaged signal.

16. The electronic device of claim 13, wherein the pitch pulse period signal boundary determination circuitry is configured to disqualify one or more peaks of the first averaged curve that have less than a threshold number of samples beyond the threshold.

17. The electronic device of claim 13, wherein the pitch pulse period signal boundary determination circuitry is configured to designate a midpoint between a pair of first averaged curve peak positions as a pitch pulse period signal boundary.

18. The electronic device of claim 13, wherein the pitch pulse period signal boundary determination circuitry is configured to determine a sliding window average of the signal.

19. The electronic device of claim 13, further comprising excitation scaling circuitry coupled to the pitch pulse period signal boundary determination circuitry, wherein the excitation scaling circuitry is configured to determine an actual energy profile and a target energy profile based on the pitch pulse period signal boundaries and a temporary synthesized speech signal.

20. The electronic device of claim 19, wherein the excitation scaling circuitry is configured to interpolate a previous frame end pitch pulse period energy and a current frame end pitch pulse period energy of the temporary synthesized speech signal.

21. The electronic device of claim 19, wherein the excitation scaling circuitry is configured to determine a scaling factor based on the actual energy profile and the target energy profile.

22. The electronic device of claim 21, wherein the excitation scaling circuitry is configured to scale an excitation signal based on the scaling factor to produce a scaled excitation signal.

23. The electronic device of claim 13, wherein the signal is an excitation signal.

24. The electronic device of claim 13, wherein the signal is a temporary synthesized speech signal.

25. A computer-program product for determining pitch pulse period signal boundaries, comprising a non-transitory tangible computer-readable medium having instructions thereon, the instructions comprising:

code for causing an electronic device to obtain a signal;

code for causing the electronic device to determine a first averaged curve based on the signal;

code for causing the electronic device to determine at least one first averaged curve peak position based on the first averaged curve and a threshold, wherein the threshold comprises a second averaged curve based on the first averaged curve;

code for causing the electronic device to determine pitch pulse period signal boundaries based on the at least one first averaged curve peak position; and code for causing the electronic device to synthesize a speech signal.

26. The computer-program product of claim 25, wherein the first averaged curve is an energy curve.

27. The computer-program product of claim 25, further comprising code for causing the electronic device to determine the second averaged curve by determining a sliding window average of the first averaged signal.

28. The computer-program product of claim 25, wherein determining the at least one averaged curve peak position comprises disqualifying one or more peaks of the first averaged curve that have less than a threshold number of samples beyond the threshold.

29. The computer-program product of claim 25, wherein determining the pitch pulse period signal boundaries comprises designating a midpoint between a pair of first averaged curve peak positions as a pitch pulse period signal boundary.

30. The computer-program product of claim 25, wherein determining the first averaged curve comprises determining a sliding window average of the signal.

31. The computer-program product of claim 25, further comprising code for causing the electronic device to determine an actual energy profile and a target energy profile based on the pitch pulse period signal boundaries and a temporary synthesized speech signal.

32. The computer-program product of claim 31, wherein determining the target energy profile comprises interpolating a previous frame end pitch pulse period energy and a current frame end pitch pulse period energy of the temporary synthesized speech signal.

33. The computer-program product of claim 31, further comprising code for causing the electronic device to determine a scaling factor based on the actual energy profile and the target energy profile.

34. The computer-program product of claim 33, further comprising code for causing the electronic device to scale an excitation signal based on the scaling factor to produce a scaled excitation signal.

35. The computer-program product of claim 25, wherein the signal is an excitation signal.

36. The computer-program product of claim 25, wherein the signal is a temporary synthesized speech signal.

37. An apparatus for determining pitch pulse period signal boundaries, comprising:

means for obtaining a signal;

means for determining a first averaged curve based on the signal;

means for determining at least one first averaged curve peak position based on the first averaged curve and a threshold, wherein the threshold comprises a second averaged curve based on the first averaged curve;

means for determining pitch pulse period signal boundaries based on the at least one first averaged curve peak position; and means for synthesizing a speech signal.

38. The apparatus of claim 37, wherein the first averaged curve is an energy curve.

39. The apparatus of claim 37, further comprising means for determining the second averaged curve by determining a sliding window average of the first averaged signal.

40. The apparatus of claim 37, wherein determining the at least one averaged curve peak position comprises disqualifying one or more peaks of the first averaged curve that have less than a threshold number of samples beyond the threshold.

41. The apparatus of claim 37, wherein determining the pitch pulse period signal boundaries comprises designating a midpoint between a pair of first averaged curve peak positions as a pitch pulse period signal boundary.

42. The apparatus of claim 37, wherein determining the first averaged curve comprises determining a sliding window average of the signal.

43. The apparatus of claim 37, further comprising means for determining an actual energy profile and a target energy profile based on the pitch pulse period signal boundaries and a temporary synthesized speech signal.

44. The apparatus of claim 43, wherein determining the target energy profile comprises interpolating a previous frame end pitch pulse period energy and a current frame end pitch pulse period energy of the temporary synthesized speech signal.

45. The apparatus of claim 43, further comprising means for determining a scaling factor based on the actual energy profile and the target energy profile.

46. The apparatus of claim 45, further comprising means for scaling an excitation signal based on the scaling factor to produce a scaled excitation signal.

47. The apparatus of claim 37, wherein the signal is an excitation signal.

48. The apparatus of claim 37, wherein the signal is a temporary synthesized speech signal.

* * * * *